US009839581B2

(12) United States Patent
Qiu et al.

(10) Patent No.: US 9,839,581 B2
(45) Date of Patent: Dec. 12, 2017

(54) PREASSEMBLED MEDICINE MIXER

(75) Inventors: Yu Qiu, Chongqing (CN); Ke Li, Chongqing (CN); Yuan Yuan, Chongqing (CN); Hongyu Li, Chongqing (CN); Yeli Huang, Chongqing (CN)

(73) Assignee: CHONGQING LUMMY PHARMACEUTICAL CO., LTD., Chongqing (CN)

( * ) Notice: Subject to any disclaimer, the term of this patent is extended or adjusted under 35 U.S.C. 154(b) by 567 days.

(21) Appl. No.: 14/415,605

(22) PCT Filed: Aug. 2, 2012

(86) PCT No.: PCT/CN2012/079609

§ 371 (c)(1),
(2), (4) Date: Jan. 19, 2015

(87) PCT Pub. No.: WO2013/149445

PCT Pub. Date: Oct. 10, 2013

(65) Prior Publication Data

US 2015/0174006 A1 Jun. 25, 2015

(30) Foreign Application Priority Data

Apr. 6, 2012 (CN) ..... 2012 1 0099077
Apr. 6, 2012 (CN) ..... 2012 1 0099091
(Continued)

(51) Int. Cl.
*A61J 1/20* (2006.01)
*A61J 1/10* (2006.01)
(Continued)

(52) U.S. Cl.
CPC ..... *A61J 1/2089* (2013.01); *A61J 1/10* (2013.01); *A61J 1/1406* (2013.01); *A61J 1/16* (2013.01);
(Continued)

(58) Field of Classification Search
CPC ..... A61J 1/1406; A61J 1/1412; A61J 1/1418–1/1431; A61J 1/1462; A61J 1/16;
(Continued)

(56) References Cited

U.S. PATENT DOCUMENTS 3,390,677 A 7/1968 Razimbaud
4,567,211 A 1/1986 Oberster et al.
(Continued)

FOREIGN PATENT DOCUMENTS

CN 1034260 C 3/1997
CN 1250365 A 4/2000
(Continued)

OTHER PUBLICATIONS

International Search Report for PCT/CN2012/079609, dated Jan. 17, 2013.
(Continued)

*Primary Examiner* — Tatyana Zalukaeva
*Assistant Examiner* — Benjamin Klein
(74) *Attorney, Agent, or Firm* — Kilpatrick Townsend & Stockton LLP

(57) ABSTRACT

A preassembled medicine mixer comprises a rotary sleeve (4), a guide sleeve I (3), a guide sleeve II (6), a guide part, a dosing barrel (1), and a dosing double needle (2). The guide sleeve I (3) extends into the guide sleeve II (6) and is connected to the rotary sleeve (4). A guide groove (8) is provided on the side wall of the guide sleeve I (3), and two ends of the guide groove (8) are extended by a distance towards opposite directions. A guide spiral groove (7) is
(Continued)

provided on an inner wall of the guide sleeve II (6). The guide part is disposed in the guide sleeve I (3) and has a guide block (9) at the outer side thereof. The guide block (9) penetrates through the guide groove (8) and extends into the guide spiral groove (7). In use, the rotary sleeve (4) is rotated to drive the guide part to rapidly move downwards and push a medicine container (17); an upper needle tip of the dosing double needle (2) pierces a sealing plug on the medicine container (17), and a lower needle tip pierces a diaphragm (23) in an interface (22), so that the medicine container (17) is instantly communicated with an infusion container (14), thereby implementing sterile closeness during the entire process of transportation, storage, butt joint, medicine mixing, and infusion.

22 Claims, 33 Drawing Sheets

(30) Foreign Application Priority Data

| | | |
|---|---|---|
| Apr. 6, 2012 | (CN) | 2012 1 0099108 |
| Apr. 6, 2012 | (CN) | 2012 1 0099109 |
| Jul. 2, 2012 | (CN) | 2012 1 0224552 |
| Jul. 2, 2012 | (CN) | 2012 1 0224553 |
| Jul. 2, 2012 | (CN) | 2012 1 0224555 |
| Jul. 2, 2012 | (CN) | 2012 1 0224556 |
| Jul. 2, 2012 | (CN) | 2012 1 0224557 |
| Jul. 2, 2012 | (CN) | 2012 1 0224563 |
| Jul. 2, 2012 | (CN) | 2012 1 0224566 |

(51) Int. Cl.
*A61J 1/14* (2006.01)
*A61J 1/16* (2006.01)

(52) U.S. Cl.
CPC ..... *A61J 1/1462* (2013.01); *A61J 1/201* (2015.05); *A61J 1/2013* (2015.05); *A61J 1/2065* (2015.05)

(58) Field of Classification Search
CPC ..... A61J 1/20; A61J 1/2003–1/2086; A61J 1/2089; A61J 1/2096
See application file for complete search history.

(56) References Cited

U.S. PATENT DOCUMENTS

| | | | | |
|---|---|---|---|---|
| 4,576,211 A | | 3/1986 | Valentini et al. | |
| 4,936,841 A | * | 6/1990 | Aoki | A61J 1/2089 206/222 |
| 5,342,346 A | * | 8/1994 | Honda | A61J 1/2089 604/411 |
| 5,826,713 A | * | 10/1998 | Sunago | A61J 1/2089 206/219 |
| 2002/0068896 A1 | | 6/2002 | Robinson et al. | |
| 2014/0311624 A1 | * | 10/2014 | Eilertsen | A61J 1/2096 141/18 |

FOREIGN PATENT DOCUMENTS

| | | | |
|---|---|---|---|
| CN | 2902281 | Y | 5/2007 |
| CN | 200954294 | Y | 10/2007 |
| CN | 200979788 | Y | 11/2007 |
| CN | 101147821 | A | 3/2008 |
| CN | 201346311 | Y | 11/2009 |
| CN | 201996844 | U | 10/2011 |
| CN | 102283774 | A | 12/2011 |
| CN | 202113338 | U | 1/2012 |
| CN | 202236340 | U | 5/2012 |
| CN | 102579261 | A | 7/2012 |
| CN | 102716031 | A | 10/2012 |
| CN | 102716032 | A | 10/2012 |
| CN | 102716034 | A | 10/2012 |
| CN | 102716037 | A | 10/2012 |
| CN | 102743292 | A | 10/2012 |
| CN | 202478177 | U | 10/2012 |
| CN | 202497450 | U | 10/2012 |
| CN | 202497451 | U | 10/2012 |
| CN | 202505773 | U | 10/2012 |
| CN | 202605315 | U | 12/2012 |
| CN | 202620235 | U | 12/2012 |
| EP | 0565103 | A1 | 10/1993 |
| FR | 2952813 | A1 | 5/2011 |
| JP | H05176970 | A | 7/1993 |
| JP | H06343678 | A | 12/1994 |
| JP | H07184979 | A | 7/1995 |
| JP | H07275324 | A | 10/1995 |
| JP | 7299148 | A | 11/1995 |
| JP | H08238300 | A | 9/1996 |
| JP | 3565609 | B2 | 9/2004 |
| JP | 2004275443 | A | 10/2004 |
| WO | 2007101772 | A1 | 9/2007 |
| WO | 2009014955 | A2 | 1/2009 |

OTHER PUBLICATIONS

The European Search Report dated Feb. 2, 2016 for EP counterpart application.
The first Office Action dated Feb. 27, 2013 regarding the Chinese priority patent application (Appl.No. CN 201210224563.X).
The second Office Action dated Mar. 26, 2014 regarding the Chinese priority patent application (Appl.No. CN 201210224557.4).

* cited by examiner

PREASSEMBLED MEDICINE MIXER

The present application is the national phase of International Application No. PCT/CN2012/079609, titled "PREASSEMBLED MEDICINE MIXER", filed on Aug. 2, 2012, which claims the benefits of priorities to Chinese Patent Application No. 201210099077.X, filed on Apr. 6, 2012, Chinese Patent Application No. 201210099091.X, filed on Apr. 6, 2012, Chinese Patent Application No. 201210099108.1, filed on Apr. 6, 2012, Chinese Patent Application No. 201210099109.6, filed on Apr. 6, 2012, Chinese Patent Application No. 201210224552.1, filed on Jul. 2, 2012, Chinese Patent Application No. 201210224553.6, filed on Jul. 2, 2012, Chinese Patent Application No. 201210224555.5, filed on Jul. 2, 2012, Chinese Patent Application No. 201210224556.X, filed on Jul. 2, 2012, Chinese Patent Application No. 201210224557.4, filed on Jul. 2, 2012, Chinese Patent Application No. 201210224563.X, filed on Jul. 2, 2012, and Chinese Patent Application No. 201210224566.3, filed on Jul. 2, 2012, all of which applications are incorporated herein in their entireties by this reference.

TECHNICAL FIELD

The present invention relates to a medical appliance, and particularly to a medicine mixer which is used in mixing medicine.

BACKGROUND

For adding medicine in a medicine container into a solution in a transfusion container (i.e., a transfusion soft bag or a transfusion soft bottle), and then transfusing the mixed solution into a patient in a clinical institution such as a hospital. In the prior art, a medicine doser is generally used to connect a medicine container and a transfusion soft bag or a transfusion soft bottle.

The medicine doser in the prior art mainly includes a dosing barrel and a dosing double needle. The dosing barrel forms a cup-shaped structure, and the dosing double needle is clamped in the dosing barrel via a double needle supporting seat. For sealing a medicine mixing passage, a diaphragm is provided on the cross section of the inner wall at the bottom end of the dosing barrel, and a sealing membrane is provided at the top end of the dosing barrel, and the dosing double needle has one needle tip corresponding to the diaphragm, and has the other needle tip corresponding to the sealing membrane above. Using the doser includes abutting the dosing barrel with an interface of the transfusion soft bag or the transfusion soft bottle, tearing the sealing membrane on the top end of the dosing barrel, and then clamping the medicine container into the dosing barrel, which meanwhile pushes the dosing double needle to move downwards, such that the upper needle tip of the dosing double needle punctures the sealing plug of the medicine container, and the lower needle tip of the dosing double needle punctures through the sealing plug at the interface of the transfusion soft bag or the transfusion soft bottle, and then just squeezing the transfusion bag or the transfusion soft bottle and the medicine mixing can be achieved.

The following disadvantages mainly exist in the medicine mixing process if the doser having the structure described above is adopted: when clamping the medicine container inside the dosing barrel, it is necessary to tear the sealing membrane at the top end of the dosing barrel first, and during the clamping, the dosing barrel may contact with the outside, and thus causing contamination. However, all the sealed doser presented in the prior art may only realize the sealing during medicine mixing, and cannot realize "the overall process being closed sterile" including the abutting of the medicine container and the doser, the medicine mixing and the transfusion.

SUMMARY OF THE INVENTION

In view of the above disadvantages existing in the prior art, the present invention provides a preassembled medicine mixer which may realize an overall closed process including transportation, storage, butt jointing, medicine mixing and transfusion in completely sterile condition.

Further, the present invention further provides a push device used in the preassembled medicine mixer which may realize an overall closed process including butt jointing, medicine mixing and transfusion in completely sterile condition.

To address the above technical problems, the following technical solutions are adopted by the present invention.

The first preassembled medicine mixer provided by the present invention includes a rotary sleeve, a guide sleeve I, a guide sleeve II, a guide component, a dosing barrel and a dosing double needle, with the dosing double needle being arranged in the dosing barrel, the guide sleeve I has one end protruding into the guide sleeve II, and has the other end connected with one end of the rotary sleeve; a guide through groove is provided axially in the side wall of the guide sleeve I, both ends of the guide through groove extend a certain distance in opposite directions on the circumference of the guide sleeve I, and the direction in which the bottom end of the guide through groove extends in the circumference of the guide sleeve I conforms with the direction in which the rotary sleeve rotates when the medicine container is pushed;

the dosing barrel has one end serving as an interface connecting end, and has the other end connected to one end of the guide sleeve II; a guide spiral groove is provided in the inner wall of the guide sleeve II; and the guide component is arranged inside the guide sleeve I, and a guide block is provided on the outer side of the guide component, the guide block passes through the guide through groove and protrudes into the guide spiral groove, to allow the rotary sleeve to cooperate with the guide sleeve II in an axially fixed and radially rotatable manner.

Further, the guide component is a flat plate, a grab bucket, a guide barrel or a push rod; the opening of the grab bucket corresponds to the dosing double needle; and the guide barrel has one end open, and the open end of the guide barrel corresponds to the dosing double needle, and the inner chamber of the guide barrel is the accommodating chamber for the medicine container.

Further, the other end of the rotary sleeve is a sealed end.

Further, the rotary sleeve and the guide sleeve I are integrally formed.

Further, a pressing ring is provided on the outer wall of the rotary sleeve in the circumferential direction, the pressing ring presses on the other end of the guide sleeve II, and cooperates with the guide sleeve II in a rotatable and sealed manner.

Further, the pressing ring cooperates with the other end of the guide sleeve II in a sealed manner via a sealing ring.

Further, two guide spiral grooves are symmetrically provided in the inner wall of the guide sleeve II, and two guide through grooves are axially symmetrically provided in the side wall of the guide sleeve I, two guide blocks are symmetrically provided on the outer side of the guide component, one of the blocks passes through one guide through groove and protrudes into one guide spiral groove, and the other guide block passes through the other guide through groove and protrudes into the other guide spiral groove.

Further, the dosing barrel and the guide sleeve II are integrally formed.

Further, two barb-shaped slip-proof buckles for preventing the medicine container from loosening are symmetrically provided on the inner wall of the dosing barrel.

Further, an annular rubber cushion is provided on the inner wall of the dosing barrel and close to the interface connecting end, and the needle tip of the dosing double needle corresponding to the interface connecting end passes through the annular rubber cushion.

Further, a clamping assembly for connecting an interface of the transfusion container and the interface connecting end is arranged at the bottom end of the dosing barrel.

Further, the clamping assembly is an annular locker which includes a first arcuate locker and a second arcuate locker, a sealing gasket is arranged on each of the inner wall of the first arcuate locker and the second arcuate locker, the first arcuate locker has one end hinged to one end of the second arcuate locker and has the other end clamped to the other end of the second arcuate locker.

Further, the lower needle of the dosing double needle has a length larger than the length of the upper needle of the dosing double needle.

The second preassembled medicine mixer provided by the present invention includes a rotary sleeve, a guide sleeve I, a guide sleeve II, a guide component, a dosing barrel and a dosing double needle, with the dosing double needle being arranged in the dosing barrel, the dosing barrel has one end serving as an interface connecting end, and has the other end connected to one end of the guide sleeve I;

the other end of the guide sleeve I protrudes into the guide sleeve II, a guide through groove is provided axially in the side wall of the guide sleeve I, both ends of the guide through groove extend a certain distance in opposite directions on the circumference of the guide sleeve I, and the direction in which the bottom end of the guide through groove extends in the circumference of the guide sleeve I conforms with the direction in which the rotary sleeve rotates when the medicine container is pushed;

a guide spiral groove is provided in the inner wall of the guide sleeve II; and the guide sleeve II is connected to one end of the rotary sleeve; and the guide component is arranged inside the guide sleeve I, and a guide block is provided on the outer side of the guide component, the guide block passes through the guide through groove and protrudes into the guide spiral groove, to allow the rotary sleeve to cooperate with the guide sleeve I in an axially fixed and radially rotatable manner.

Further, the guide component is a flat plate, a grab bucket, a guide barrel or a push rod; the opening of the grab bucket corresponds to the dosing double needle; and the guide barrel has one end open, and the open end of the guide barrel corresponds to the dosing double needle, the inner chamber of the guide barrel is the accommodating chamber for the medicine container.

Further, the other end of the rotary sleeve is a sealed end.

Further, the rotary sleeve and the guide sleeve II are integrally formed.

Further, a pressing ring is provided on the inner wall of the rotary sleeve in the circumferential direction, the pressing ring presses on the other end of the guide sleeve I, and cooperates with the guide sleeve I in a rotatable and sealed manner.

Further, the pressing ring cooperates with the other end of the guide sleeve I in a sealed manner via a sealing ring.

Further, two guide spiral grooves are symmetrically provided in the inner wall of the guide sleeve II, and two guide through grooves are axially symmetrically provided in the side wall of the guide sleeve I, two guide blocks are symmetrically provided on the outer side of the guide component, one of the blocks passes through one guide through groove and protrudes into one guide spiral groove, and the other guide block passes through the other guide through groove and protrudes into the other guide spiral groove.

Further, the dosing barrel and the guide sleeve I are integrally formed.

Further, two barb-shaped slip-proof buckles for preventing the medicine container from loosening are symmetrically provided on the inner wall of the dosing barrel.

Further, an annular rubber cushion is provided on the inner wall of the dosing barrel and close to the interface connecting end, and the needle tip of the dosing double needle corresponding to the interface connecting end passes through the annular rubber cushion.

Further, a clamping assembly for connecting an interface of the transfusion container and the interface connecting end is arranged at the bottom end of the dosing barrel.

Further, the clamping assembly is an annular locker which includes a first arcuate locker and a second arcuate locker, a sealing gasket is arranged on each of the inner wall of the first arcuate locker and the second arcuate locker, the first arcuate locker has one end hinged to one end of the second arcuate locker and has the other end clamped to the other end of the second arcuate locker.

Further, the lower needle of the dosing double needle has a length larger than the length of the upper needle of the dosing double needle.

The third preassembled medicine mixer provided by the present invention includes a rotary sleeve, a guide sleeve I, a guide sleeve II, a guide component, a dosing barrel and a dosing double needle, with the dosing double needle being arranged in the dosing barrel, the dosing barrel has one end serving as an interface connecting end, and has the other end connected to one end of the guide sleeve II; and a guide spiral through groove is provided in the inner wall of the guide sleeve II;

the other end of the guide sleeve II protrudes into the guide sleeve I, and the guide sleeve I is connected to one end of the rotary sleeve; a guide groove is provided axially in the side wall of the guide sleeve I, both ends of the guide groove extend a certain distance in opposite directions on the circumference of the guide sleeve I, and the direction in which the bottom end of the guide groove extends in the circumference of the guide sleeve I conforms with the direction in which the rotary sleeve rotates when the medicine container is pushed; and the guide component is arranged inside the guide sleeve II, and a guide block is provided on the outer side of the guide component, the guide block passes through the guide spiral through groove and protrudes into the guide groove, to allow the rotary sleeve to cooperate with the guide sleeve II in an axially fixed and radially rotatable manner.

Further, the guide component is a flat plate, a grab bucket, a guide barrel or a push rod; the opening of the grab bucket corresponds to the dosing double needle; and the guide barrel has one end open, and the open end of the guide barrel corresponds to the dosing double needle, the inner chamber of the guide barrel is the accommodating chamber for the medicine container.

Further, the other end of the rotary sleeve is a sealed end.

Further, the rotary sleeve and the guide sleeve I are integrally formed.

Further, a pressing ring is provided on the inner wall of the rotary sleeve in the circumferential direction, the pressing ring presses on the other end of the guide sleeve II, and cooperates with the guide sleeve II in a rotatable and sealed manner.

Further, the pressing ring cooperates with the other end of the guide sleeve II in a sealed manner via a sealing ring.

Further, two guide spiral through grooves are symmetrically provided in the inner wall of the guide sleeve II, and two guide grooves are axially symmetrically provided in the side wall of the guide sleeve I, two guide blocks are symmetrically provided on the outer side of the guide component, one of the blocks passes through one guide spiral through groove and protrudes into one guide groove, and the other guide block passes through the other guide spiral through groove and protrudes into the other guide groove.

Further, the dosing barrel and the guide sleeve II are integrally formed.

Further, two barb-shaped slip-proof buckles for preventing the medicine container from loosening are symmetrically provided on the inner wall of the dosing barrel.

Further, an annular rubber cushion is provided on the inner wall of the dosing barrel and close to the interface connecting end, and the needle tip of the dosing double needle corresponding to the interface connecting end passes through the annular rubber cushion.

Further, a clamping assembly for connecting an interface of the transfusion container and the interface connecting end is arranged at the bottom end of the dosing barrel.

Further, the clamping assembly is an annular locker which includes a first arcuate locker and a second arcuate locker, a sealing gasket is arranged on each of the inner wall of the first arcuate locker and the second arcuate locker, the first arcuate locker has one end hinged to one end of the second arcuate locker and has the other end clamped to the other end of the second arcuate locker.

Further, the lower needle of the dosing double needle has a length larger than the length of the upper needle of the dosing double needle.

The fourth preassembled medicine mixer provided by the present invention includes a rotary sleeve, a guide sleeve I, a guide sleeve II, a guide component, a dosing barrel and a dosing double needle, with the dosing double needle being arranged in the dosing barrel, the dosing barrel has one end serving as an interface connecting end, and has the other end connected to one end of the guide sleeve I;

a guide groove is provided axially in the side wall of the guide sleeve I, both ends of the guide groove extend a certain distance in opposite directions on the circumference of the guide sleeve I, and the direction in which the bottom end of the guide groove extends in the circumference of the guide sleeve I conforms with the direction in which the rotary sleeve rotates when the medicine container is pushed;

the guide sleeve II has one end protruding into the guide sleeve I, and has the other end connected to one end of the rotary sleeve, and a guide spiral through groove is provided in the inner wall of the guide sleeve II; and the guide component is arranged inside the guide sleeve II, and a guide block is provided on the outer side of the guide component, the guide block passes through the guide spiral through groove and protrudes into the guide groove, to allow the rotary sleeve to cooperate with the guide sleeve I in an axially fixed and radially rotatable manner.

Further, the guide component is a flat plate, a grab bucket, a guide barrel or a push rod; the opening of the grab bucket corresponds to the dosing double needle; and the guide barrel has one end open, and the open end of the guide barrel corresponds to the dosing double needle, the inner chamber of the guide barrel is the accommodating chamber for the medicine container.

Further, the other end of the rotary sleeve is a sealed end.

Further, the rotary sleeve and the guide sleeve II are integrally formed.

Further, a pressing ring is provided on the outer wall of the rotary sleeve in the circumferential direction, the pressing ring presses on the other end of the guide sleeve I, and cooperates with the guide sleeve I in a rotatable and sealed manner.

Further, the pressing ring cooperates with the other end of the guide sleeve I in a sealed manner via a sealing ring.

Further, two guide spiral through grooves are symmetrically provided in the inner wall of the guide sleeve II, and two guide grooves are axially symmetrically provided in the side wall of the guide sleeve I, two guide blocks are symmetrically provided on the outer side of the guide component, one of the blocks passes through one guide spiral through groove and protrudes into one guide groove, and the other guide block passes through the other guide spiral through groove and protrudes into the other guide groove.

Further, the dosing barrel and the guide sleeve I are integrally formed

Further, two barb-shaped slip-proof buckles for preventing the medicine container from loosening are symmetrically provided on the inner wall of the dosing barrel.

Further, an annular rubber cushion is provided on the inner wall of the dosing barrel and close to the interface connecting end, and the needle tip of the dosing double needle corresponding to the interface connecting end passes through the annular rubber cushion.

Further, a clamping assembly for connecting an interface of the transfusion container and the interface connecting end is arranged at the bottom end of the dosing barrel.

Further, the clamping assembly is an annular locker which includes a first arcuate locker and a second arcuate locker, a sealing gasket is arranged on each of the inner wall of the first arcuate locker and the second arcuate locker, the first arcuate locker has one end hinged to one end of the second arcuate locker and has the other end clamped to the other end of the second arcuate locker.

Further, the lower needle of the dosing double needle has a length larger than the length of the upper needle of the dosing double needle.

The push device used in the first preassembled medicine mixer provided by the present invention, includes a rotary sleeve, a guide sleeve I, a guide sleeve II and a guide component, the guide sleeve I has one end protruding into the guide sleeve II, and has the other end connected with one end of the rotary sleeve; a guide through groove is provided axially in the side wall of the guide sleeve I, both ends of the guide through groove extend a certain distance in opposite directions on the circumference of the guide sleeve I, and the direction in which the bottom end of the guide through groove extends in the circumference of the guide sleeve I conforms with the direction in which the rotary sleeve rotates when the medicine container is pushed; a guide spiral groove is provided in the inner wall of the guide sleeve II; and the guide component is arranged inside the guide sleeve I, and a guide block is provided on the outer side of the guide component, the guide block passes through the guide through groove and protrudes into the guide spiral groove, to allow the rotary sleeve to cooperate with the guide sleeve II in an axially fixed and radially rotatable manner.

Further, the guide component is a flat plate, a grab bucket, a guide barrel or a push rod; the opening of the grab bucket faces downwards; and the guide barrel has one end open, and the open end of the guide barrel faces downwards, and the inner chamber of the guide barrel is the accommodating chamber for the medicine container.

Further, the other end of the rotary sleeve is a sealed end.

Further, the rotary sleeve and the guide sleeve I are integrally formed.

Further, a pressing ring is provided on the outer wall of the rotary sleeve in the circumferential direction, the pressing ring presses on the other end of the guide sleeve II, and cooperates with the guide sleeve II in a rotatable and sealed manner.

Further, the pressing ring cooperates with the other end of the guide sleeve II in a sealed manner via a sealing ring.

Further, two guide spiral grooves are symmetrically provided in the inner wall of the guide sleeve II, and two guide through grooves are axially symmetrically provided in the side wall of the guide sleeve I, two guide blocks are symmetrically provided on the outer side of the guide component, one of the blocks passes through one guide through groove and protrudes into one guide spiral groove, and the other guide block passes through the other guide through groove and protrudes into the other guide spiral groove.

The push device used in the second preassembled medicine mixer provided by the present invention includes a rotary sleeve, a guide sleeve I, a guide sleeve II and a guide component, the guide sleeve I has one end protruding into the guide sleeve II, a guide through groove is provided axially in the side wall of the guide sleeve I, both ends of the guide through groove extend a certain distance in opposite directions on the circumference of the guide sleeve I, and the direction in which the bottom end of the guide through groove extends in the circumference of the guide sleeve I conforms with the direction in which the rotary sleeve rotates when the medicine container is pushed; a guide spiral groove is provided in the inner wall of the guide sleeve II, the guide sleeve II is connected to one end of the rotary sleeve; and the guide component is arranged inside the guide sleeve I, and a guide block is provided on the outer side of the guide component, the guide block passes through the guide through groove and protrudes into the guide spiral groove, to allow the rotary sleeve to cooperate with the guide sleeve I in an axially fixed and radially rotatable manner.

Further, the guide component is a flat plate, a grab bucket, a guide barrel or a push rod; the opening of the grab bucket faces downwards; and the guide barrel has one end open, and the open end of the guide barrel faces downwards, and the inner chamber of the guide barrel is the accommodating chamber for the medicine container.

Further, the other end of the rotary sleeve is a sealed end.

Further, the rotary sleeve and the guide sleeve II are integrally formed.

Further, a pressing ring is provided on the inner wall of the rotary sleeve in the circumferential direction, the pressing ring presses on the other end of the guide sleeve I, and cooperates with the guide sleeve I in a rotatable and sealed manner.

Further, the pressing ring cooperates with the other end of the guide sleeve I in a sealed manner via a sealing ring.

Further, two guide spiral grooves are symmetrically provided in the inner wall of the guide sleeve II, and two guide through grooves are axially symmetrically provided in the side wall of the guide sleeve I, two guide blocks are symmetrically provided on the outer side of the guide component, one of the blocks passes through one guide through groove and protrudes into one guide spiral groove, and the other guide block passes through the other guide through groove and protrudes into the other guide spiral groove.

The push device used in third preassembled medicine mixer provided by the present invention includes a rotary sleeve, a guide sleeve I, a guide sleeve II and a guide component, the guide sleeve II has one end protruding into the guide sleeve I, a guide spiral through groove is provided in the inner wall of the guide sleeve II; the guide sleeve I is connected to one end of the rotary sleeve; a guide groove is provided axially in the side wall of the guide sleeve I, both ends of the guide groove extend a certain distance in opposite directions on the circumference of the guide sleeve I, and the direction in which the bottom end of the guide groove extends in the circumference of the guide sleeve I conforms with the direction in which the rotary sleeve rotates when the medicine container is pushed; and the guide component is arranged inside the guide sleeve II, and a guide block is provided on the outer side of the guide component, the guide block passes through the guide spiral through groove and protrudes into the guide groove, to allow the rotary sleeve to cooperate with the guide sleeve II in an axially fixed and radially rotatable manner.

Further, the guide component is a flat plate, a grab bucket, a guide barrel or a push rod; the opening of the grab bucket faces downwards; and the guide barrel has one end open, and the open end of the guide barrel faces downwards, and the inner chamber of the guide barrel is the accommodating chamber for the medicine container.

Further, the other end of the rotary sleeve is a sealed end.

Further, the rotary sleeve and the guide sleeve I are integrally formed.

Further, a pressing ring is provided on the inner wall of the rotary sleeve in the circumferential direction, the pressing ring presses on the other end of the guide sleeve II, and cooperates with the guide sleeve II in a rotatable and sealed manner.

Further, the pressing ring cooperates with the other end of the guide sleeve II in a sealed manner via a sealing ring.

Further, two guide spiral through grooves are symmetrically provided in the inner wall of the guide sleeve II, and two guide grooves are axially symmetrically provided in the side wall of the guide sleeve I, two guide blocks are symmetrically provided on the outer side of the guide component, one of the blocks passes through one guide spiral through groove and protrudes into one guide groove, and the other guide block passes through the other guide spiral through groove and protrudes into the other guide groove.

The push device used in the fourth preassembled medicine mixer provided by the present invention includes a rotary sleeve, a guide sleeve I, a guide sleeve II and a guide component, the guide sleeve II has one end protruding into the guide sleeve I, and has the other end connected to one end of the rotary sleeve; a guide spiral through groove is provided in the inner wall of the guide sleeve II; a guide groove is provided axially in the side wall of the guide sleeve I, both ends of the guide groove extend a certain distance in opposite directions on the circumference of the guide sleeve I, and the direction in which the bottom end of the guide groove extends in the circumference of the guide sleeve I conforms with the direction in which the rotary sleeve rotates when the medicine container is pushed; and the guide component is arranged inside the guide sleeve II, and a guide block is provided on the outer side of the guide component, the guide block passes through the guide spiral through groove and protrudes into the guide groove, to allow the rotary sleeve to cooperate with the guide sleeve I in an axially fixed and radially rotatable manner.

Further, the guide component is a flat plate, a grab bucket, a guide barrel or a push rod; the opening of the grab bucket faces downwards; and the guide barrel has one end open, and the open end of the guide barrel faces downwards, and the inner chamber of the guide barrel is the accommodating chamber for the medicine container.

Further, the other end of the rotary sleeve is a sealed end.

Further, the rotary sleeve and the guide sleeve II are integrally formed.

Further, a pressing ring is provided on the outer wall of the rotary sleeve in the circumferential direction, the pressing ring presses on the other end of the guide sleeve I, and cooperates with the guide sleeve I in a rotatable and sealed manner.

Further, the pressing ring cooperates with the other end of the guide sleeve I in a sealed manner via a sealing ring.

Further, two guide spiral through grooves are symmetrically provided in the inner wall of the guide sleeve II, and two guide grooves are axially symmetrically provided in the side wall of the guide sleeve I, two guide blocks are symmetrically provided on the outer side of the guide component, one of the blocks passes through one guide spiral through groove and protrudes into one guide groove, and the other guide block passes through the other guide spiral through groove and protrudes into the other guide groove.

The present invention has advantageous effects that, using the preassembled medicine mixer may include butt jointing the bottom of the dosing barrel and the interface of the transfusion soft bag or the transfusion soft bottle first, and preassembling the medicine container into the guide component or to be under the guide component, and then butt jointing the guide sleeve II and the top portion of the dosing barrel in a sealed manner. The medicine container and the dosing double needle are kept in a sealed condition via the diaphragm in the interface and the rotary sleeve having the top end sealed, and hence may achieve absolute sterile transportation and storage. Mixing medicine may include rotating the rotary sleeve to drive the guide component to move downwards rapidly along the guide groove provided in the guide sleeve or the guide spiral groove provided in the guide sleeve II, and then bring the medicine container under the guide component or in the guide component to move downwards, and thus, the medicine container applies a pressure to the dosing double needle, to drive the dosing double needle to move downwards, such that the upper needle tip of the dosing double needle punctures through a sealing plug on the medicine container, and the lower needle tip of the dosing double needle punctures through the diaphragm in the interface, to allow the medicine container to be instantaneously communicated with the transfusion soft bag or the transfusion soft bottle, and the overall process is in a state of sterile butt jointing, hence, the sterile sealing in an overall process including transportation, storage, butt jointing, medicine mixing and transfusion can be achieved by the preassembled medicine mixer.

IN THE DRAWINGS

| | | | |
|---|---|---|---|
| 1 | dosing barrel; | 2 | dosing double needle; |
| 3 | guide sleeve I; | 4 | rotary sleeve; |
| 5 | guide barrel; | 6 | guide sleeve II; |
| 7 | guide spiral groove; | 8 | guide through groove; |
| 9 | guide block; | 10 | pressing ring; |
| 11 | sealing ring; | 12 | annular rubber cushion; |
| 13 | lifting ring; | 14 | transfusion container; |
| 15 | double needle supporting seat; | 16 | slip-proof buckle; |
| 17 | medicine container; | 18 | annular locker; |
| 19 | annular recess; | 20 | annular locker groove; |
| 22 | interface; | 23 | diaphragm; |
| 24 | clamping assembly; | 241 | first arcuate locker; |
| 242 | second arcuate locker; | 243 | sealing gasket; |
| 244 | reverse buckle; | 25 | interface connecting end; |
| 26 | push rod; | 27 | guide spiral through groove; |
| 28 | guide groove; and | 29 | air vent. |

DETAILED EMBODIMENTS

The present invention is further described in detail hereinafter in conjunction with drawings and specific embodiments.

Reference is made to FIGS. 1 to 14 for the structure of the first preassembled medicine mixer.

The preassembled medicine mixer includes a rotary sleeve 4, a guide sleeve I 3, a guide sleeve II 6, a guide component, a dosing barrel 1 and a dosing double needle 2.

Figure 1:
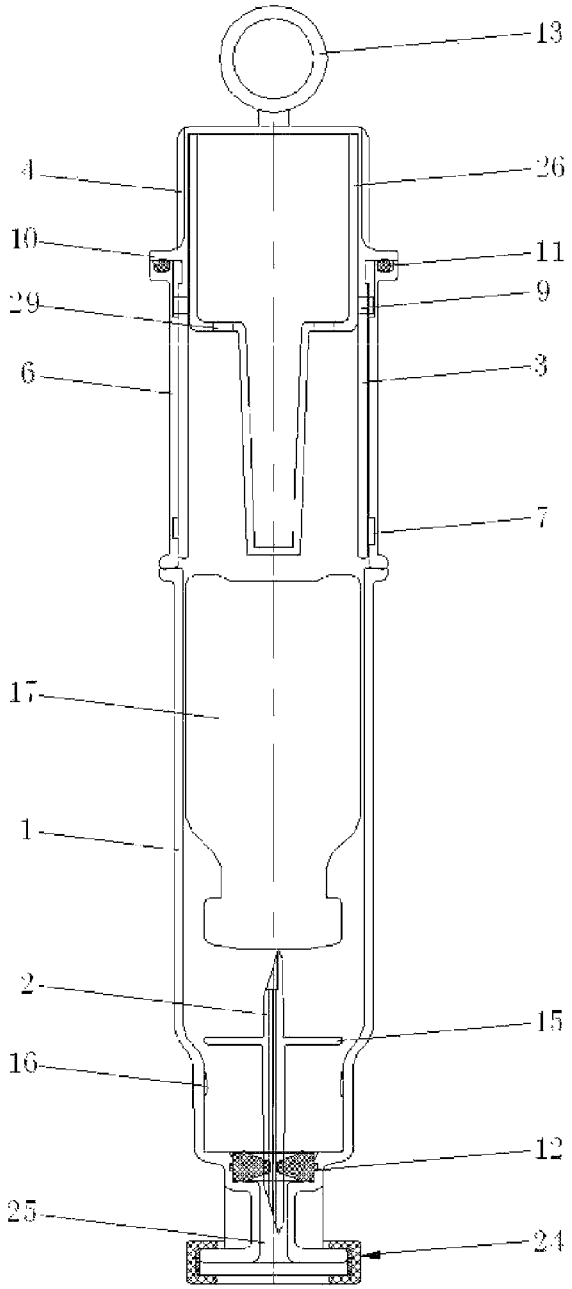
FIG. 1 is a schematic view showing the structure of the first preassembled medicine mixer.
Figure 2:
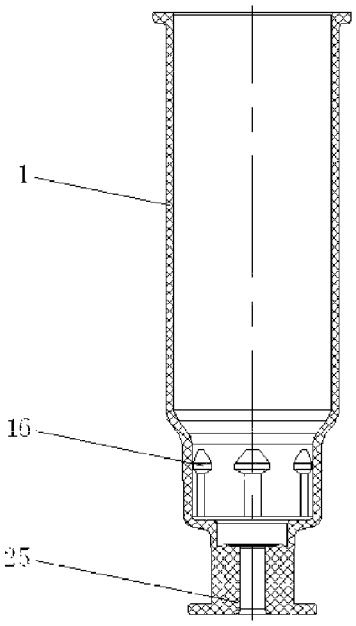
FIG. 2 is a sectional schematic view showing the structure of the dosing barrel in the first preassembled medicine mixer.
Figure 13:
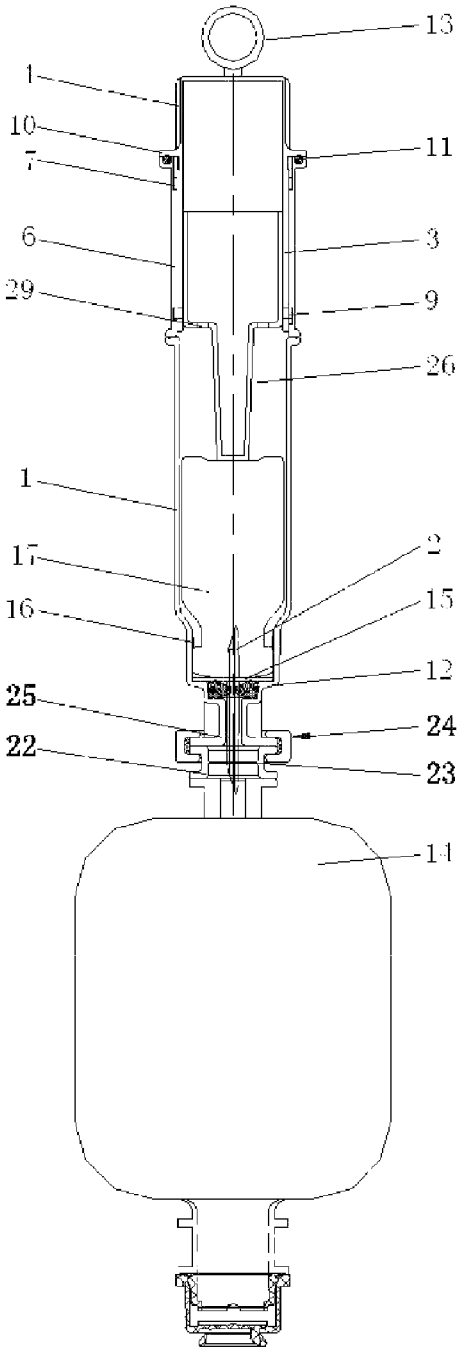
FIG. 13 is a schematic view showing the structure of the first preassembled medicine mixer which is connected to a transfusion container and in a state of being used, employing the push rod as the guide component.

The structure of the dosing barrel 1 is as shown in FIG. 2. The bottom end of the dosing barrel 1 serves as an interface connecting end 25, and the inner wall of the interface connecting end 25 has a necking structure, which is more advantageous for the matching of the interface dimension of a transfusion container 14 (i.e., a transfusion soft bag or a transfusion soft bottle). An annular rubber cushion 12 is provided on the inner wall of the dosing barrel 1 and close to the interface connecting end 25. The dosing double needle 2 (the dosing double needle 2 is embodied as a cross needle, i.e., an upper needle, a lower needle and a double needle supporting seat 15 are integrally formed and a cutting plane along an axis of the dosing double needle has a "+" H-shaped structure of this example) is arranged in the dosing barrel 1, with its lower needle tip passing through the annular rubber cushion 12 and being stuck to the annular rubber cushion 12. The double needle supporting seat 15 of the dosing double needle 2 is located above the annular rubber cushion 12. The lower needle of the dosing double needle 2 has a length larger than a length of the upper needle of the dosing double needle 2. At least two barb-shaped slip-proof buckles 16 are symmetrically provided on the inner wall of the dosing barrel 1 (in this example, four slip-proof buckles are symmetrically arranged on the inner wall of the dosing barrel 1). In a state that the medicine in a medicine container 17 is mixed with the solution in a transfusion container 14 (as shown in FIG. 13) after the medicine container 17 is assembled in the dosing barrel 1, the bottle cap of the medicine container 17 is stuck below the slip-proof buckles 16, and the slip-proof buckles 16 may effectively prevent the medicine container 17 from retreating, and ensure the medicine mixing to be carried out smoothly.

Figure 3:
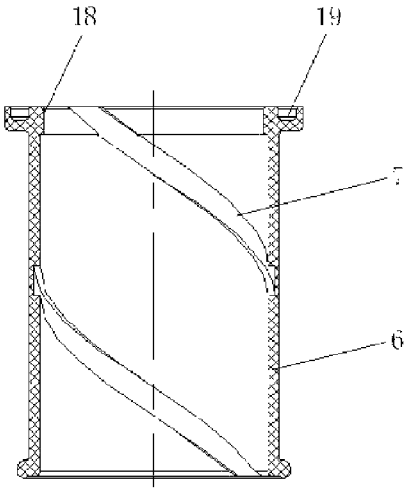
FIG. 3 is a sectional schematic view showing the structure of the guide sleeve II in the first preassembled medicine mixer.

The structure of the guide sleeve II 6 is as shown in FIG. 3, and the bottom end of the guide sleeve II 6 abuts against the top end of the dosing barrel 1 in a sealed manner (the connection can be achieved by welding). A guide spiral groove 7 is provided in the inner wall of the guide sleeve II 6, and in this example, two guide spiral grooves 7 are symmetrically arranged in the inner wall of the guide sleeve II 6. An annular locker 18 is provided at the top of the inner wall of the guide sleeve II 6 in the circumferential direction, and an annular recess 19 is provided in the top end surface of the guide sleeve II 6 in the circumferential direction.

Figure 4:
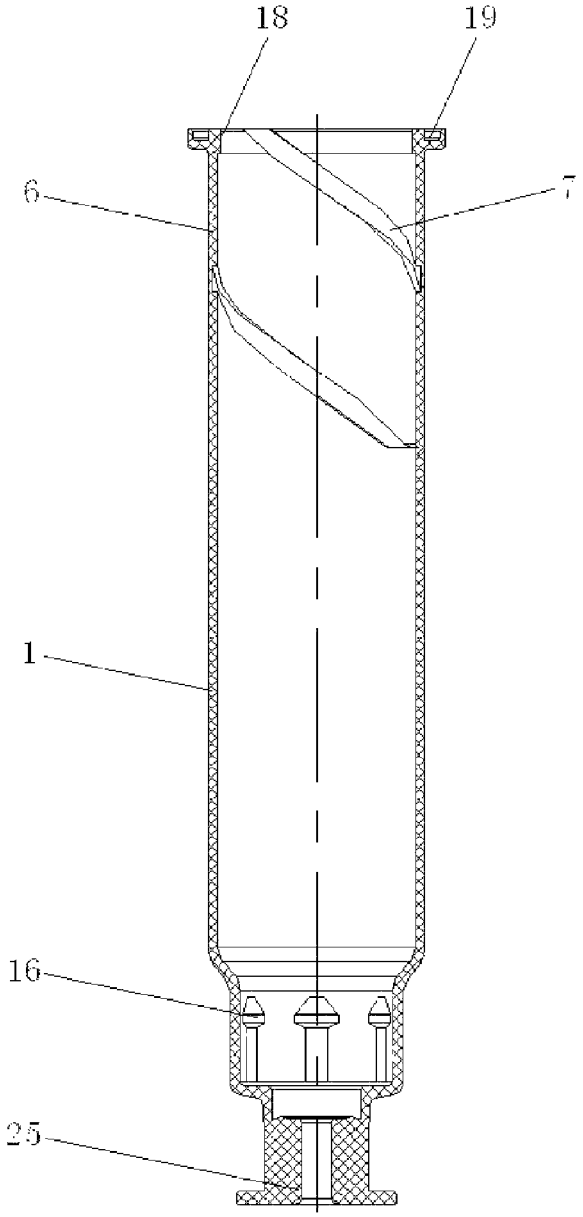
FIG. 4 is a sectional schematic view showing the structure of the guide sleeve II and the dosing barrel integrally formed in the first preassembled medicine mixer.

The guide sleeve II 6 and the dosing barrel 1 can be integrally formed, as shown in FIG. 4.

Figure 5:
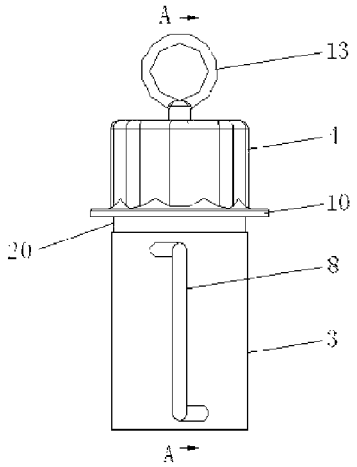
FIG. 5 is a front view showing the rotary sleeve and the guide sleeve I integrally formed in the first preassembled medicine mixer.
Figure 6:
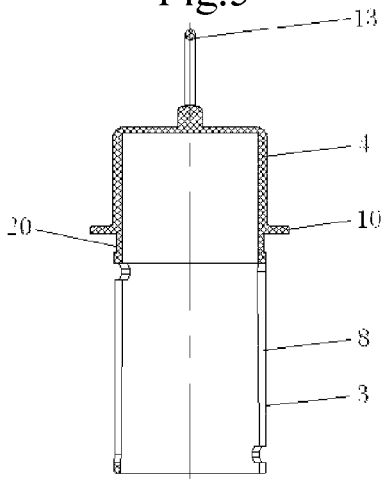
FIG. 6 is a sectional view along the direction of A-A in FIG. 5.
Figure 12:
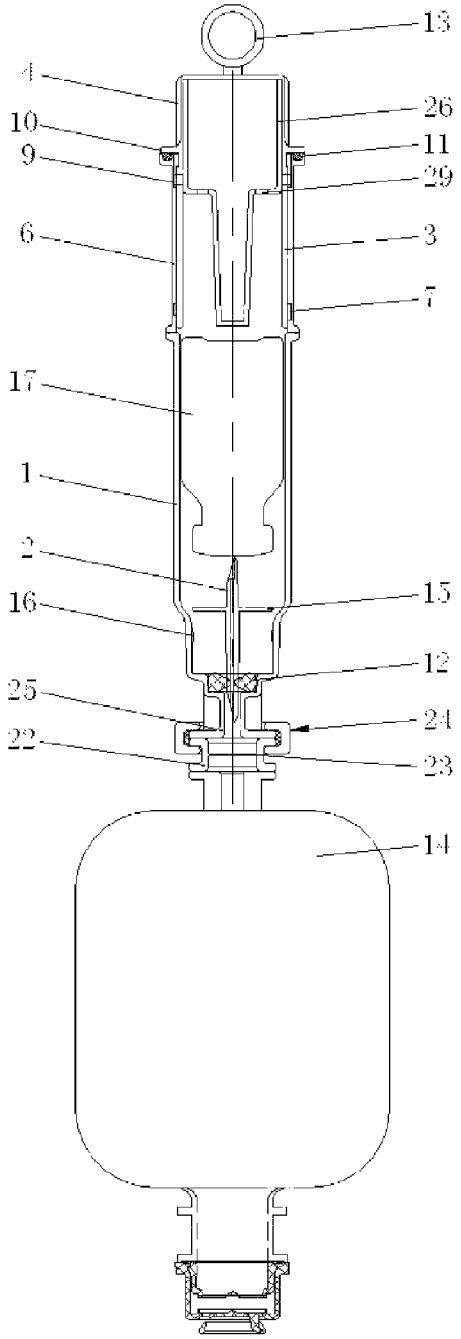
FIG. 12 is a schematic view showing the structure of the first preassembled medicine mixer which is connected to a transfusion container and in a state before use, employing the push rod as the guide component.
Figure 14:
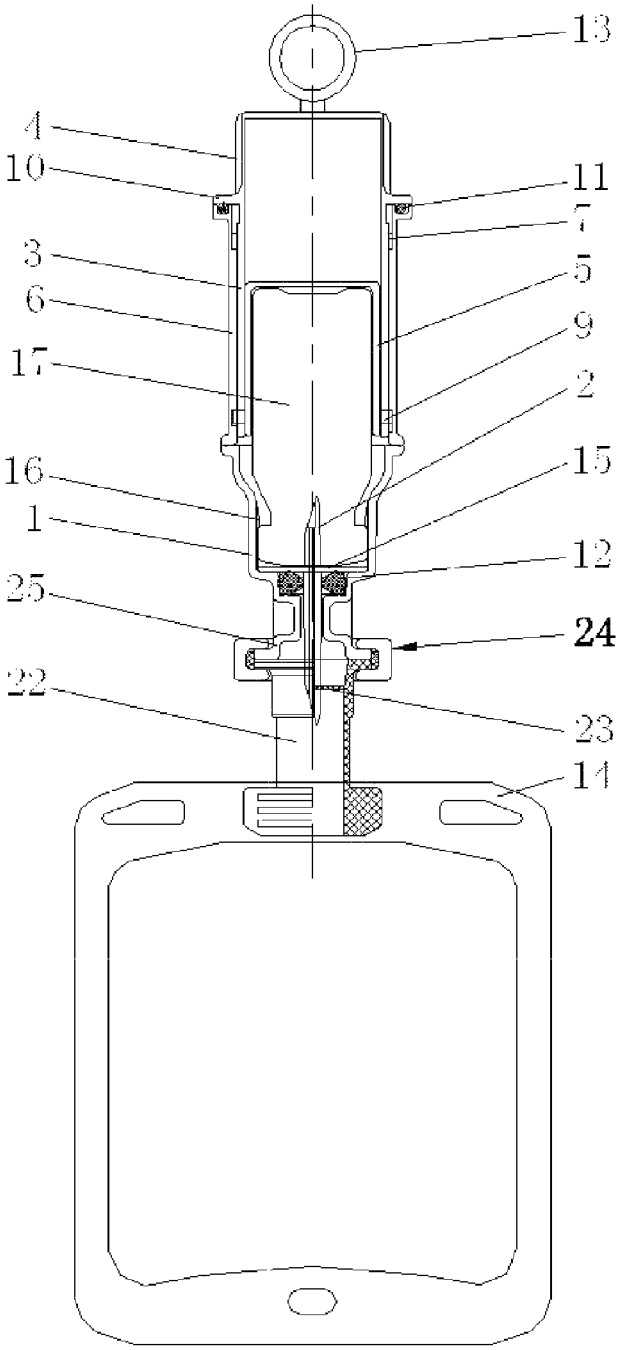
FIG. 14 is a schematic view showing the structure of the first preassembled medicine mixer which is connected to a transfusion container and in a state of being used, employing the guide barrel as the guide component.

The structures of the guide sleeve I 3 and the rotary sleeve 4 are as shown in FIGS. 5 and 6. In this example, the guide sleeve I 3 and the rotary sleeve 4 are integrally formed. The guide sleeve I 3 protrudes into the guide sleeve II 6, and the top end of the guide sleeve I 3 is connected to the bottom end of the rotary sleeve 4 (butt-jointed by welding). The rotary sleeve 4 cooperates with the guide sleeve II 6 in an axially fixed and radially rotatable manner, and in a sealed manner, with the top end of the rotary sleeve 4 being a sealed end. In this example, a pressing ring 10 is provided on the outer wall of the rotary sleeve 4 in the circumferential direction, and an annular locker groove 20 is provided below the pressing ring 10 in the circumferential direction. The annular locker 18 is located in the annular locker groove 20 in a state that the rotary sleeve 4 is installed to the guide sleeve II 6. A sealing ring 11 is stalled in the annular recess 19, and the pressing ring 10 presses on the top end of the guide sleeve II 6 via the sealing ring 11 and cooperates with the guide sleeve II 6 in a sealed manner. When the rotary sleeve 4 is rotated, the annular locker 18 rotates inside the annular locker groove 20, and due to the sealing effect of the sealing ring 11, not only the rotary sleeve 4 is rotatable on the guide sleeve II 6, but also the sealing between the outer wall of the rotary sleeve 4 and the top of the guide sleeve II 6 can be achieved. A guide through groove 8 is provided axially in the side wall of the guide sleeve I 3 (in this example, two guide grooves 8 are provided axially symmetrically in the side wall of the guide sleeve I 3). Both ends of the guide through groove 8 extend on the circumference of the guide sleeve I 3 by a certain distance along the opposite direction, to form a character "z"-shaped guide through groove 8. The direction in which the bottom end of the guide through groove 8 extends in the circumference of the guide sleeve I 3 conforms with the direction in which the rotary sleeve 4 rotates when the medicine container is pushed. Before the medicine in the medicine container 17 and the solution in the transfusion container 14 is mixed (as shown in FIG. 12), a guide block 9 on the guide component is located in a groove of the guide through groove 8 at the top end and in the circumferential direction, which effectively prevents the guide component from moving from downwards axially, and prevents the guide component from pushing the medicine container 17 to move downwards before mixing medicine. While the medicine in the medicine container 17 and the solution in the transfusion container 14 is mixed (as shown in FIGS. 13 and 14), the guide block 9 on the guide component is located in a groove of the guide through groove 8 at the bottom end in the circumferential direction, which effectively prevents the guide component from moving from upwards axially, and thereby effectively preventing the medicine container 17 from retreating, and further ensuring that the medicine mixing can be carried out smoothly.

The guide component is a flat plate, a grab bucket, a guide barrel 5 or a push rod 26. In the case that the guide component is embodied as a flat plate, a guide block 9 is provided at each of both sides of the flat plate. When the doser is used, it is simply required to directly placing the medicine container 17 in the guide sleeve I 3 and under the flat plate, the downward guide moving is achieved via the guide blocks arranged at both sides of the flat plate, and the flat plate contacts the medicine container 17 and may directly push the medicine container 17 to move downwards.

In the case that the guide component is embodied as a grab bucket, the opening of the grab bucket faces downwards and corresponds to the dosing double needle 2, guide blocks 9 are provided symmetrically on the outer wall at both sides of the grab bucket. When the doser is used, the medicine container 17 is required to be placed in the grab bucket in advance, and the grab bucket grabs the medicine container 17, the downwards guide moving is achieved by the guide blocks arranged on the outer wall at two sides of the grab bucket, and thus the grab bucket may directly push the medicine container 17 to move downwards.

Figure 7:
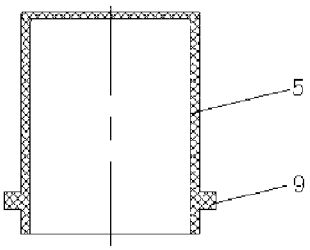
FIG. 7 is sectional schematic view showing the structure of the guide barrel as the guide component in the first preassembled medicine mixer.
Figure 8:
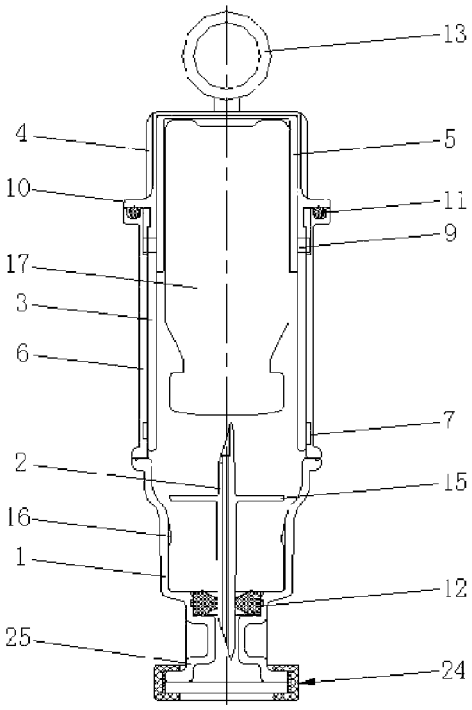
FIG. 8 is a schematic view showing the structure of the first preassembled medicine mixer in which the guide barrel is employed as the guide component.

The guide component is embodied as the guide barrel 5, one end of the guide barrel 5 is open, and the open end of the guide barrel 5 corresponds to the dosing double needle 2, and the inner chamber of the guide barrel 5 is the accommodating chamber for a medicine container, and two guide blocks 9 are symmetrically arranged on the outer wall of the guide barrel 5 (as shown in FIGS. 7 and 8). When the doser is used, it is required to place the medicine container 17 into the guide barrel 5 in advance, and the inner wall of the guide barrel 5 effectively prevents the medicine container 17 from swaying around during being used, and the medicine container 17 may be directly pushed to move downwards by the guide barrel 5.

Figure 9:
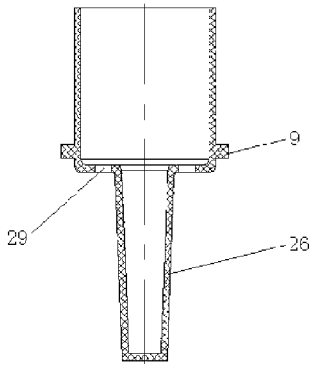
FIG. 9 is a sectional schematic view showing the structure of the push rod as the guide component in the first preassembled medicine mixer.
Figure 10:
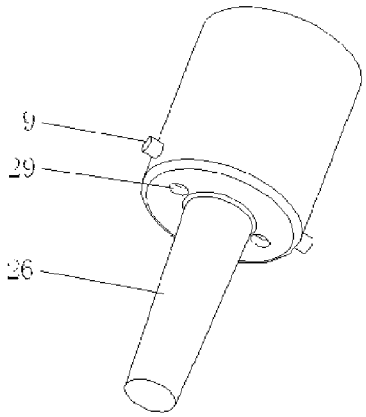
FIG. 10 is perspective view showing the structure of the push rod as the guide component in the first preassembled medicine mixer.

The guide component may also be embodied as the push rod 26, and the structure of the push rod 26 is as shown in FIGS. 9 and 10. The push rod 26 is arranged inside the rotary sleeve 4 in the axial direction of the rotary sleeve 4. The push rod 26 has a hollow structure with an upper end open and a lower end sealed, and the push rod 26 forms a hollow structure in which an upper inner hole has a large diameter, and a lower inner hole has a small diameter. Air vents 29 are uniformly distributed on a bottom wall of the upper inner hole in the axially direction. During the push rod 26 moving downwards, the air vents 29 are advantageous for air in a lower space to flow into an upper space, and reducing the resistance from air when the push rod 26 moves downwards. Two guide blocks 9 are arranged symmetrically on the outer wall of the push rod 26, one of the guide blocks 9 passes through a guide through groove 8, and protrudes into one guide spiral groove 7, and the other guide block 9 passes through another guide through groove 8 and protrudes into the other guide spiral groove 7. The push rod 26 is arranged in the rotary sleeve 4 along the axis of the rotary sleeve 4, and the upper needle tip of the dosing double needle 2 corresponds to the push rod 26. In a state that the medicine container 17 is placed in the dosing barrel 1, the bottom of the push rod 26 corresponds to a middlemost point of the top of the medicine container 17, and the upper needle tip of the dosing double needle 2 corresponds to a bottle cap of the medicine container 17.

Figure 11:
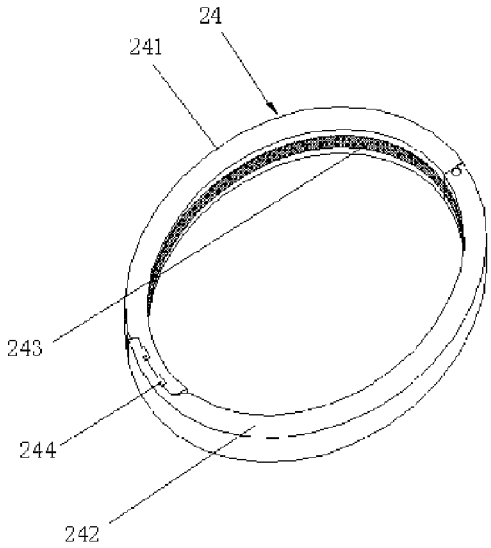
FIG. 11 is a schematic view showing the structure of the clamping assembly in the first preassembled medicine mixer.

A clamping assembly 24 for connecting an interface of the transfusion container 14 and the interface connecting end 25 is arranged at the bottom of the interface connecting end 25, (as shown in FIGS. 11 to 14). The clamping assembly 24 is an annular locker which includes a first arcuate locker 241 and a second arcuate locker 242, the cross sections of the first arcuate locker 241 and the second arcuate locker 242 both have a concaved structure, and a sealing gasket 243 is arranged in each of the inner recesses of the first arcuate locker 241 and the second arcuate locker 242. The first arcuate locker 241 has one end hinged to one end of the second arcuate locker 242 and has the other end clamped to the other end of the second arcuate locker 242. In this example, the other end of the first arcuate locker 241 and the other end of the second arcuate locker 242 are overlapped and then connected in a clamped manner, i.e., reverse buckle 244 are respectively provided on the inner sides facing each other of the other end of the first arcuate locker 241 and the other end of the second arcuate locker 242, and the other end of the first arcuate locker 241 and the other end of the second arcuate locker 242 are connected in a clamped manner via the reverse buckle 244 thereon (as shown in FIG. 11). Connecting the interface connecting end 25 of the dosing barrel 1 and the interface 22 of the transfusion container 14 includes abutting an annular boss at the bottom of the interface connecting end 25 and an annular boss on the interface 22 against each other, and then clamping the first arcuate locker 241 and the second arcuate locker 242 of the clamping assembly 24 on the annular boss at the bottom of the interface connecting end 25 and the annular boss on the interface 22, the first arcuate locker 241 and the second arcuate locker 242 are connected to each other in a clipped manner via the reverse buckle 244 thereon, and the interface connecting end 25 on the dosing barrel 1 is connected to the interface 22 of the transfusion container 14 in a sealed manner via a sealing gasket 243 in the clamping assembly 24.

A lifting ring 13 is provided at the sealed end of the rotary sleeve 4 (i.e., the top of the rotary sleeve 4), and the doser and the transfusion container 14 connected to the doser (as shown in FIGS. 12 to 14) can be hanged together on a supporting frame used in transfusion via this lifting ring 13.

Using the first preassembled medicine mixer includes: connecting the bottom end of the dosing barrel 1 and the interface 22 on the transfusion container 14 via the clamping assembly 24 in a sealed manner first (the connection in a sealed manner may also be achieved by welding and by screw threads connection), and in this example, the transfusion container 14 is embodied as a transfusion soft bag, as shown in FIG. 12, preassembling the medicine container 17 into the dosing barrel 1 in a sterile condition, and keeping the medicine container 17 and the dosing double needle 2 in a sealed condition via a diaphragm 23 in the interface 22 and the rotary sleeve 4 having the top end being sealed, and hence may achieve absolute sterile transportation and storage. Mixing medicine may include rotating the rotary sleeve 4, such that the rotary sleeve 4 drives the push rod 26 to move downwards rapidly along the guide spiral groove 7 in the inner wall of the guide sleeve II 6, to directly apply a pressure to the medicine container 17, and further push the dosing double needle 2 to move downwards, such that an upper needle tip of the dosing double needle 2 punctures through a sealing plug on the medicine container 17, and the lower needle tip of the dosing double needle 2 punctures through the diaphragm 23 in the interface 22, to allow the medicine container 17 to be instantaneously communicated with the transfusion soft bag, as shown in FIG. 13. The overall process is in a state of sterile docking, and the overall process is achieved by rotating the rotary sleeve 4 to drive the push rod 26 to move downwards. The moving downwards of the push rod 26 can be achieved only by rotating the rotary sleeve 4, which may prevent the push rod 26 from compressing the medicine container 17 during transportation and storage. When the guide block 9 on the push rod 26 moves downwards in the groove at the bottom end of the guide through groove 8 in the circumferential direction, the medicine container 17 is pushed to have a container cap of the container located below the slip-proof buckles 16, which effectively prevents the medicine container 17 from retreating, and ensures the medicine mixing to be carried out smoothly. Since the medicine container and the components directly contact with the medicine involved in a process from the medicine container being preassembled into the preassembled medicine mixer till completion of the transfusion are all in a sterile state, thus, the sterile sealing in an overall process of transportation, storage, butt jointing, medicine mixing and transfusion can be achieved. Before medicine mixing and when in medicine mixing, the medicine container 17 is located in the dosing barrel 1, and since the dosing barrel 1 is made of a transparent material, the operator may see the information of the medicine dispensed in the medicine container 17 simply through the transparent dosing barrel 1, which is advantageous for the operator to get the information of the medicine dispensed in a timely manner, and to avoid dispensing error of the medicine.

The dosing barrel 1 may also be embodied as a structure of a medicine mixing clamping body as shown in FIGS. 8 and 14, in which, the guide component is embodied as a guide barrel 5. When in use, it is required to preassemble the medicine container 17 into the guide barrel 5 in a sterile condition first, and allow the medicine container 17 and the dosing double needle 2 to be in a sealed state via the diaphragm 23 in the interface 22 and the rotary sleeve 4 with the top end being sealed, and hence may achieve the absolute sterile in the transportation and storage. Mixing medicine may include rotating the rotary sleeve 4 such that the rotary sleeve 4 drives the guide sleeve 5 to move downwards rapidly along the guide spiral groove 7 in the inner wall of the guide sleeve II 6, and in turn brings the medicine container 17 in the guide barrel 5 to move downwards. The medicine container 17 applies pressure to the dosing double needle 2 and drives the dosing double needle 2 to move downwards, and the upper needle tip of the dosing double needle 2 punctures through the sealing plug on the medicine container 17, and the lower needle tip of the dosing double needle 2 punctures through the diaphragm 23 in the interface 22, to allow the medicine container 17 and the transfusion soft bag to be communicated instantaneously, as shown in FIG. 14. The medicine container 17 is preassembled in the guide barrel 5, thus significantly reduces the distance by which the guide barrel 5 and the medicine container 17 move downwards (i.e., medicine mixing in a short travel is achieved).

Figure 15:
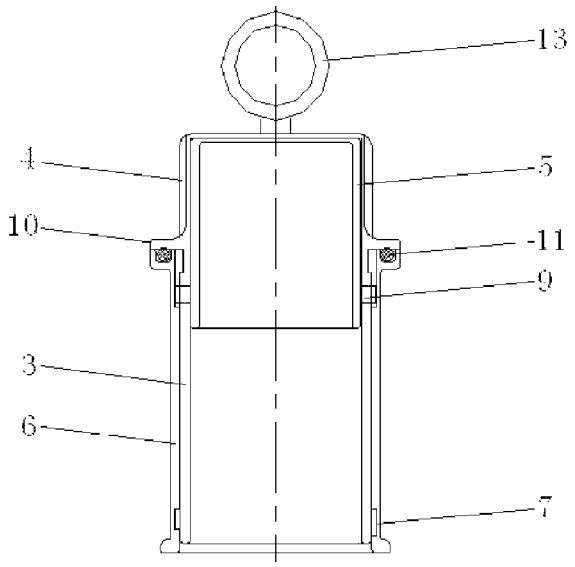
FIG. 15 is a schematic view showing the structure of a push device used in the first preassembled medicine mixer, employing the guide barrel as the guide component.
Figure 16:
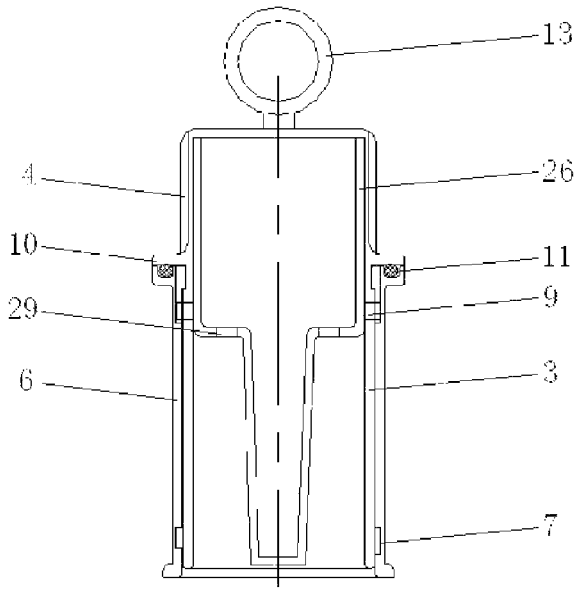
FIG. 16 is a schematic view showing the structure of the push device used in the first preassembled medicine mixer, employing the push rod as the guide component.
Figure 17:
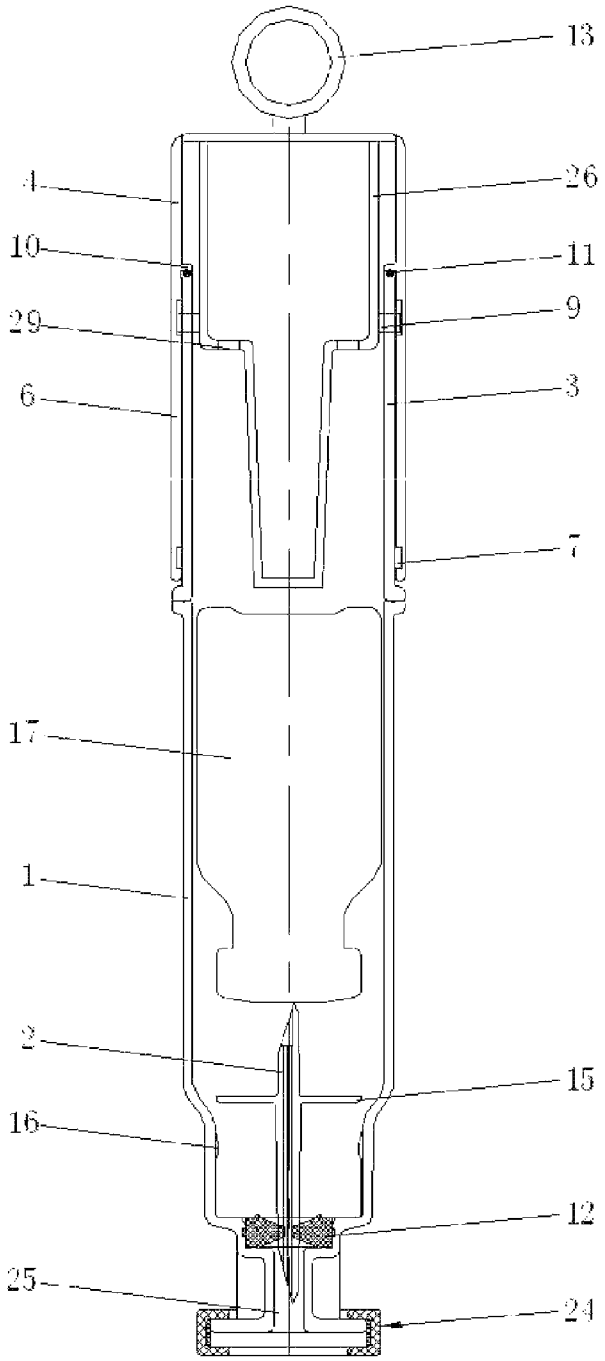
FIG. 17 is a schematic view showing the structure of the second preassembled medicine mixer.

Reference may be made to FIGS. 15 and 16 for the structure of the push device used in the first preassembled medicine mixer.

The push device used in this preassembled medicine mixer includes a rotary sleeve 4, a guide sleeve I 3, a guide sleeve II 6 and a guide component. The guide sleeve I 3 protrudes into the guide sleeve II 6, and the top end of the guide sleeve I 3 is connected to the bottom end of the rotary sleeve 4 (butt jointed by welding), and the top end of the rotary sleeve 4 is sealed. In this example, the rotary sleeve and the guide sleeve I 3 are integrally formed. A guide through groove 8 is provided axially in the side wall of the guide sleeve I 3, and both ends of the guide through groove 8 extend a certain distance in opposite directions on the circumference of the guide sleeve I 3. The direction in which the bottom end of the guide through groove 8 extends in the circumference of the guide sleeve I 3 conforms with the direction in which the rotary sleeve 4 rotates when the medicine container is pushed. A guide spiral groove is arranged in the inner wall of the guide sleeve II 6. The guide component is arranged in the guide sleeve I 3, and a guide block 9 is arranged on the outer side of the guide component, such that the guide block 9 passes through the guide through groove 8 and protrudes into the guide spiral groove 7, to allow the rotary sleeve 4 to cooperate with the guide sleeve II 6 in an axially fixed and radially rotatable manner.

The guide component is a flat plate, a grab bucket, a guide barrel or a push rod. The structures of the rotary sleeve 4, the guide sleeve I 3, the guide sleeve II 6, the guide barrel 5 and the push rod 26 are the same as the structures of those in a first preassembled medicine mixer, and are not described herein.

Assembling the push device used in the preassembled medicine mixer includes assembling the guide component (FIG. 15 shows that the guide component is embodied as a guide barrel 5, and FIG. 16 shows that the guide component is embodied as a push rod 26) in the guide sleeve I 3 first, and then allowing the guide block 9 on the guide component to pass through the guide through groove 8 in the guide sleeve I 3, and then pushing the guide component to a junction end of the guide sleeve I 3 and the rotary sleeve 7; and then sleeving the guide sleeve II 6 on the guide sleeve I 3, to allow the guide block 9 on the guide component to be inserted in the guide spiral groove 7 in the guide sleeve II 6, and closing the rotary sleeve 4 onto the top of the guide sleeve II 6.

The method for medicine mixing by an assembly of the push device used in the first preassembled medicine mixer, the dosing barrel and the dosing double needle is the same as the method for medicine mixing by the first preassembled medicine mixer, and is not described herein.

Reference may be made to FIGS. 17 to 24 for the structure of the second preassembled medicine mixer.

The preassembled medicine mixer includes a rotary sleeve 4, a guide sleeve I 3, a guide sleeve II 6, a guide component, a dosing barrel 1 and a dosing double needle 2.

The structures of the dosing barrel 1 and the dosing double needle 2 in the dosing barrel 1 are the same as the structures of those in the first preassembled medicine mixer, and are not described herein.

Figure 18:
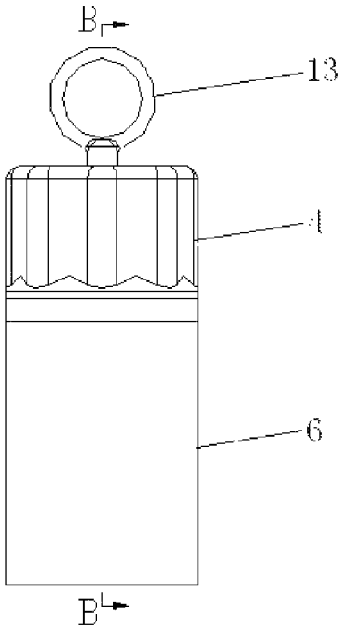
FIG. 18 is a front view showing the rotary sleeve and the guide sleeve II integrally formed in the second preassembled medicine mixer.
Figure 19:
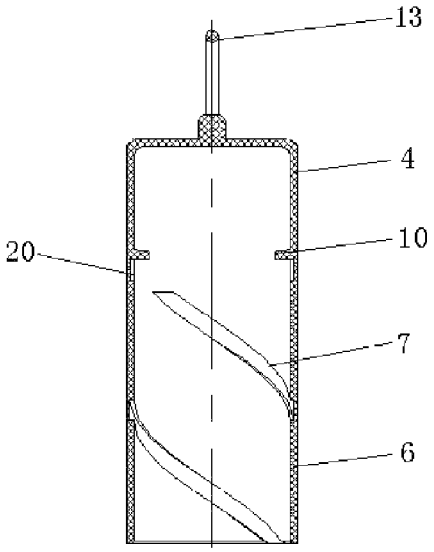
FIG. 19 is a sectional view along the direction of B-B in FIG. 18.

The structures of the guide sleeve II 6 and the rotary sleeve 4 are as shown in FIGS. 18 and 19, in this example, the guide sleeve II 6 and the rotary sleeve 4 are integrally formed, and the top end of the rotary sleeve 4 is sealed. A guide spiral groove 7 is provided in the inner wall of the guide sleeve II 6, and in this example, two guide spiral grooves 7 are symmetrically provided in the inner wall of the guide sleeve II 6. A pressing ring 10 is arranged on the inner wall of the rotary sleeve 4 in the circumferential direction, and an annular locker groove 20 is arranged under the pressing ring 10 in the circumferential direction.

Figure 20:
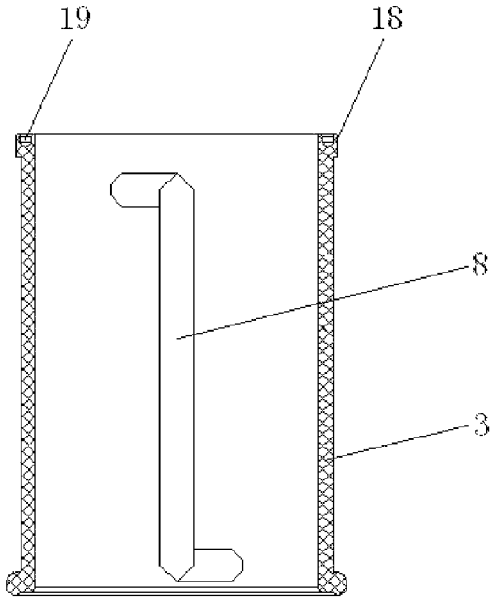
FIG. 20 is a schematic view showing the structure of a guide sleeve I in the second preassembled medicine mixer.
Figure 22:
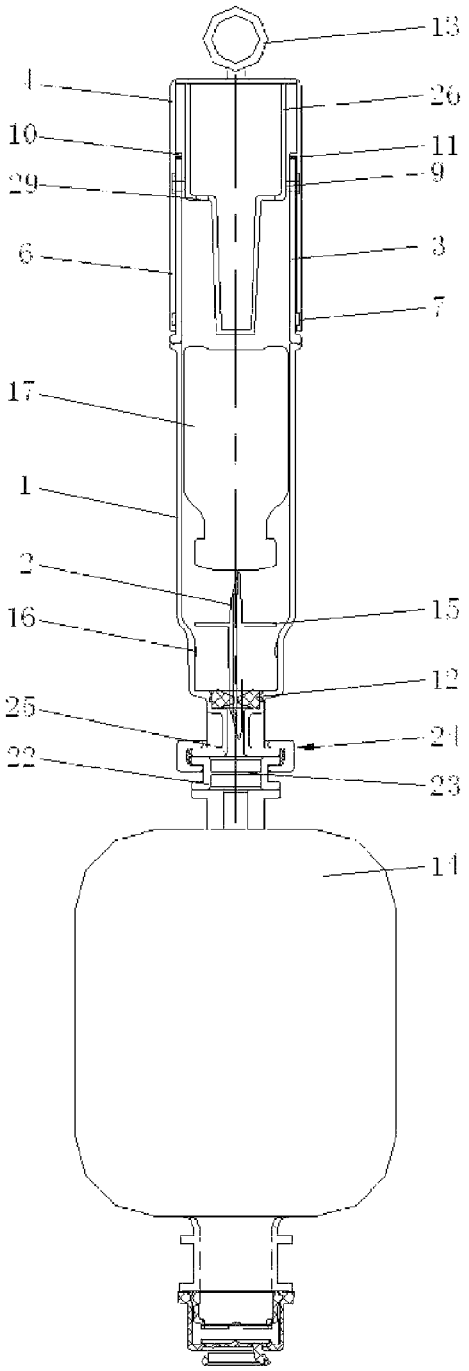
FIG. 22 is a schematic view showing the structure of the second preassembled medicine mixer which is connected to a transfusion container and in a state before use, employing the push rod as the guide component.
Figure 23:
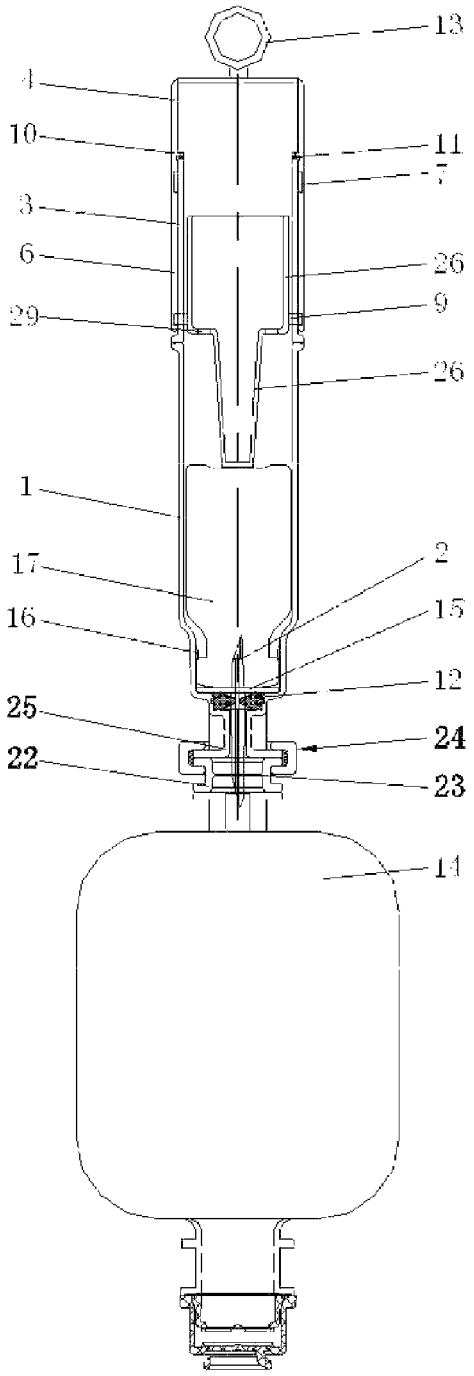
FIG. 23 is a schematic view showing the structure of the second preassembled medicine mixer which is connected to a transfusion container and in a state of being used, employing the push rod as the guide component.
Figure 24:
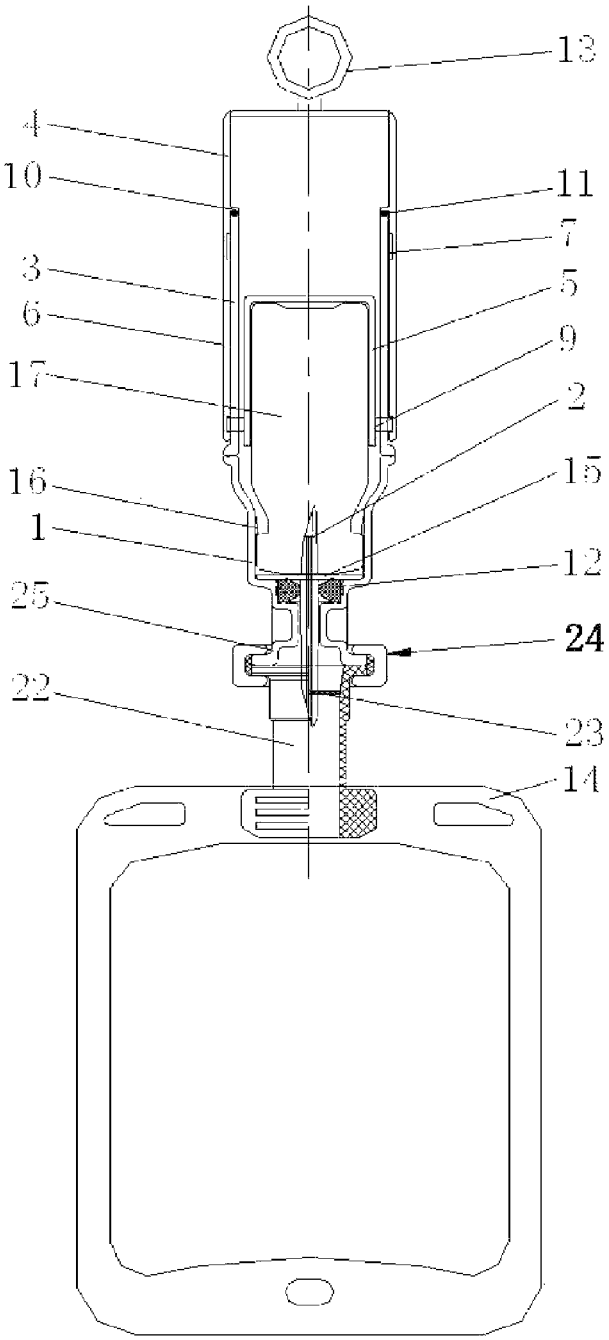
FIG. 24 is a schematic view showing the structure of the second preassembled medicine mixer which is connected to a transfusion container and in a state of being used, employing the guide barrel as the guide component.

The structure of the guide sleeve I 3 is as shown in FIG. 20, and the bottom end of the guide sleeve I 3 and the top end of the dosing barrel 1 are butt jointed in a sealed manner (the connection can be achieved by welding). The guide sleeve I 3 protrudes into the guide sleeve II 6. An annular locker 18 is provided at the top of the outer wall of the guide sleeve I 3 in the circumferential direction, and an annular recess 19 is provided on the top end face of the guide sleeve I 3 in the circumferential direction. In a state that the rotary sleeve 4 is installed on the guide sleeve I 3, the annular locker 18 is located in the annular locker groove 20. A sealing ring 11 is installed in the annular recess 19, and the pressing ring 10 presses on the guide sleeve I 3 via the sealing ring 11 and cooperates with the guide sleeve I 3 in a sealed manner. When the rotary sleeve 4 is rotated, the annular locker 18 is rotated in the annular locker groove 20, and due to the sealing effect of the sealing ring 11, not only the rotary sleeve 4 is rotatable on the guide sleeve I 3, but also the sealing between the inner wall of the rotary sleeve 4 and the top of the guide sleeve I 3 can be achieved. A guide through groove 8 is provided axially in the side wall of the guide sleeve I 3 (in this example, two guide grooves 8 are axially symmetrically provided in the side wall of the guide sleeve I 3). Both ends of the guide through groove 8 extends on the circumference of the guide sleeve I 3 by a certain distance along the opposite direction, to form a character "z"-shaped guide through groove 8. The direction in which the bottom end of the guide through groove 8 extends in the circumference of the guide sleeve I 3 conforms with the direction in which the rotary sleeve 4 rotates when the medicine container is pushed. Before the medicine in the medicine container 17 and the solution in the transfusion container 14 is mixed (as shown in FIG. 22), a guide block 9 on the guide component is located in a groove of the guide through groove 8 at the top end and in the circumferential direction, which effectively prevents the guide component from moving downwards axially, and prevents the guide component from pushing the medicine container 17 to move downwards before medicine mixing. While the medicine in the medicine container 17 and the solution in the transfusion container 14 are mixed (as shown in FIGS. 23 and 24), the guide block 9 on the guide component is located in a groove of the guide through groove 8 at the bottom end in the circumferential direction, which effectively prevents the guide component from moving upwards axially, and thereby effectively preventing the medicine container 17 from retreating, and further ensuring that the medicine mixing can be carried out smoothly.

Figure 21:
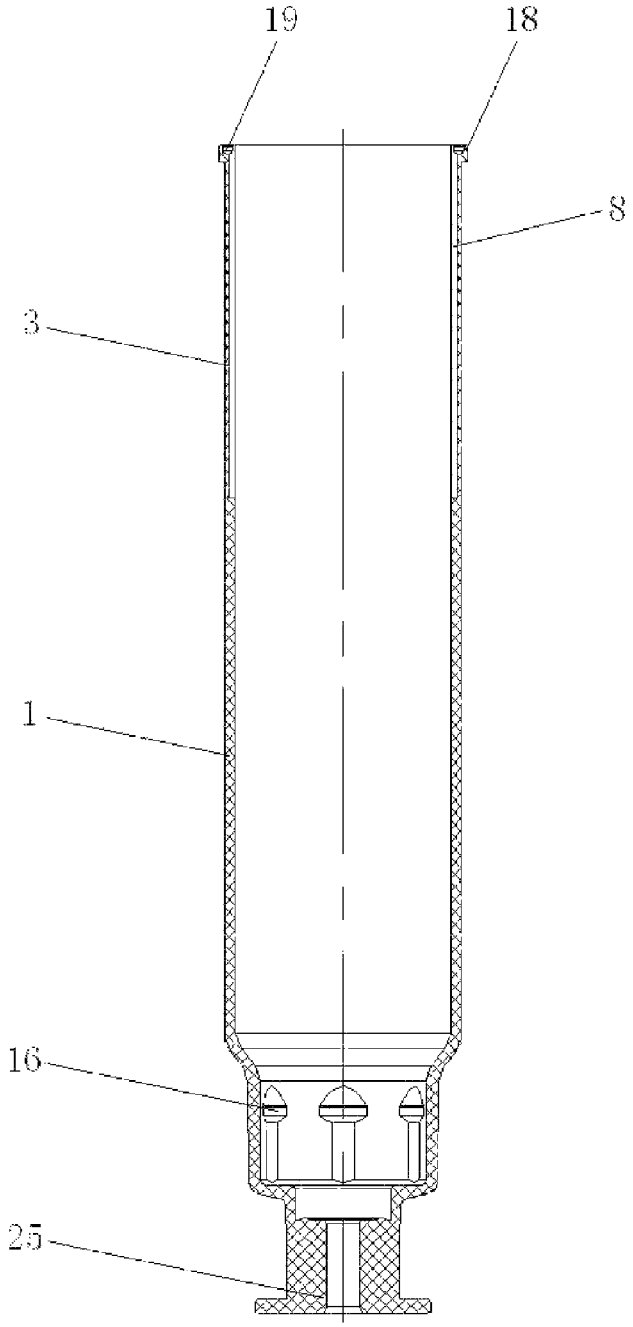
FIG. 21 is a sectional schematic view showing the structure of a dosing barrel and the guide sleeve I integrally formed in the second preassembled medicine mixer.

The guide sleeve I 3 can be integrally formed with the dosing barrel 1, as shown in FIG. 21.

The guide component is a flat plate, a grab, a guide barrel or a push rod. The guide barrel 5 and the push rod 26 have the same structures as the structures of those in the first preassembled medicine mixer, and the installing positions and working principles of the flat plate, the grab bucket, the guide barrel or the push rod are all the same as the installing positions and working principles of those in the first preassembled medicine mixer, and are not described any more herein. A clamping assembly 24 is also provided at the bottom of the dosing barrel 1, and a lifting ring 13 is provided at the top of the rotary sleeve 4.

Using the second preassembled medicine mixer employing the push rod as the guide component, includes connecting the bottom end of the dosing barrel 1 and the interface 22 on the transfusion container 14 via the clamping assembly 24 in a sealed manner, as shown in FIG. 22, and preassembling the medicine container 17 into the dosing barrel 1 in a sterile condition, keeping the medicine container 17 and the dosing double needle 2 in a sealed state via a diaphragm 23 in the interface 22 and the rotary sleeve 4 with the top end being sealed, thus may achieve absolute sterile of transportation and storage. Mixing medicine may include rotating the rotary sleeve 4, such that the rotary sleeve 4 drives the push rod 26 to move downwards rapidly along the guide through groove 8 in the guide sleeve I 3, to directly apply a pressure to the medicine container 17, and in turn push the dosing double needle 2 to move downwards, such that the upper needle tip of the dosing double needle 2 punctures through a sealing plug on the medicine container 17, and the lower needle tip of the dosing double needle 2 punctures through the diaphragm 23 in the interface 22, to allow the medicine container 17 to be instantaneously communicated with the transfusion soft bag, as shown in FIG. 23. When the guide block 9 on the push rod 26 moves downwards in a groove at the bottom end of the guide through groove 8 in the circumferential direction, the medicine container 17 is pushed to have a container cap of the container located below the slip-proof buckles 16, which effectively prevents the medicine container 17 from retreating, and ensures the medicine mixing to be carried out smoothly. Since the medicine container and the components directly contact with the medicine involved in a process from the medicine container being preassembled into the preassembled medicine mixer till completion of the transfusion are all in a sterile condition, the sterile sealing in an overall process of transportation, storage, butt jointing, mixing medicine and transfusion can be achieved. Before medicine mixing and when in medicine mixing, the medicine container 17 is located in the dosing barrel 1, since the dosing barrel 1 is made of a transparent material, the operator may see the information of the medicine dispensed in the medicine container 17 simply through the transparent dosing barrel 1, which is advantageous for the operator to get the information of the medicine dispensed in a timely manner, and to avoid dispensing error of the medicine.

The dosing barrel 1 may also be embodied as a structure of a medicine mixing clamping body as shown in FIG. 24, and the guide component is embodied as a guide barrel 5. When in use, it is required to preassemble the medicine container 17 into the guide barrel 5 in a sterile condition first, and allow the medicine container 17 and the dosing double needle 2 to be in a sealed state via the diaphragm 23 in the interface 22 and the rotary sleeve 4 with the top end being sealed, hence may achieve the absolute sterile in the transportation and storage. Mixing medicine may include rotating the rotary sleeve 4 such that the rotary sleeve 4 drives the guide sleeve 5 to move downwards rapidly along the guide through groove 8 in the inner wall of the guide sleeve I 3, and further drives the medicine container 17 in the guide barrel 5 to move downwards, such that the medicine container 17 applies pressure to the dosing double needle 2 and drives the dosing double needle 2 to move downwards, and the upper needle tip of the dosing double needle 2 punctures through the sealing plug on the medicine container 17, and the lower needle tip of the dosing double needle 2 punctures through the diaphragm 23 in the interface 22, to allow the medicine container 17 and the transfusion soft bag to be communicated instantaneously, as shown in FIG. 24. The medicine container 17 is preassembled in the guide barrel 5, thus significantly reduces the distance by which the guide barrel 5 and the medicine container 17 move downwards (i.e., medicine mixing in a short travel is achieved).

Figure 25:
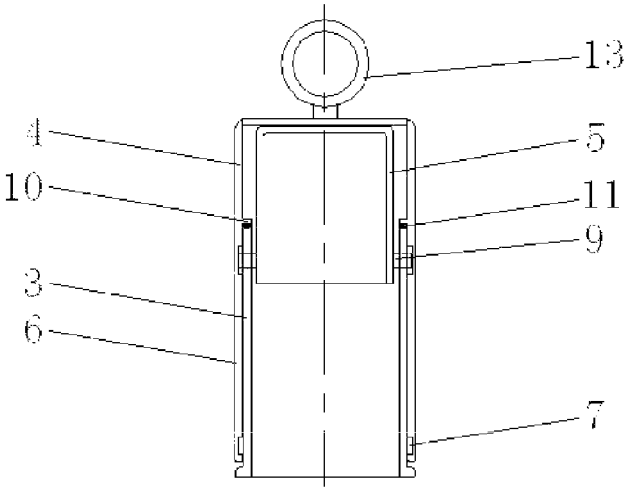
FIG. 25 is a schematic view showing the structure of the push device used in the second preassembled medicine mixer, employing the guide barrel as the guide component.
Figure 26:
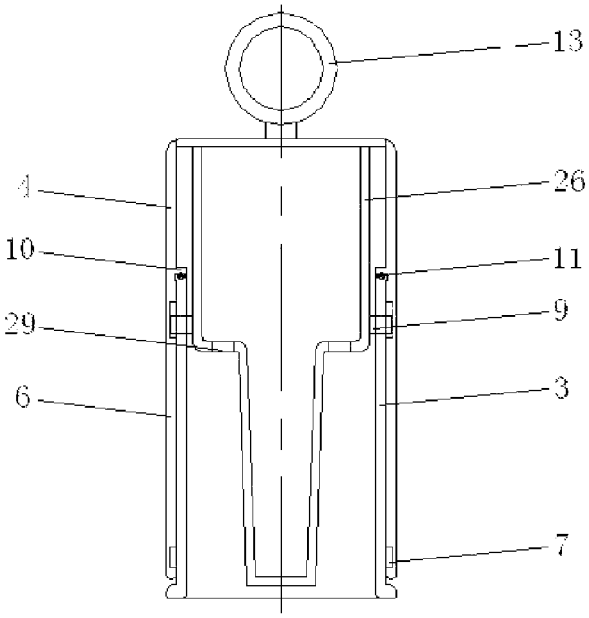
FIG. 26 is a schematic view showing the structure of the push device used in the second preassembled medicine mixer, employing the push rod as the guide component.
Figure 27:
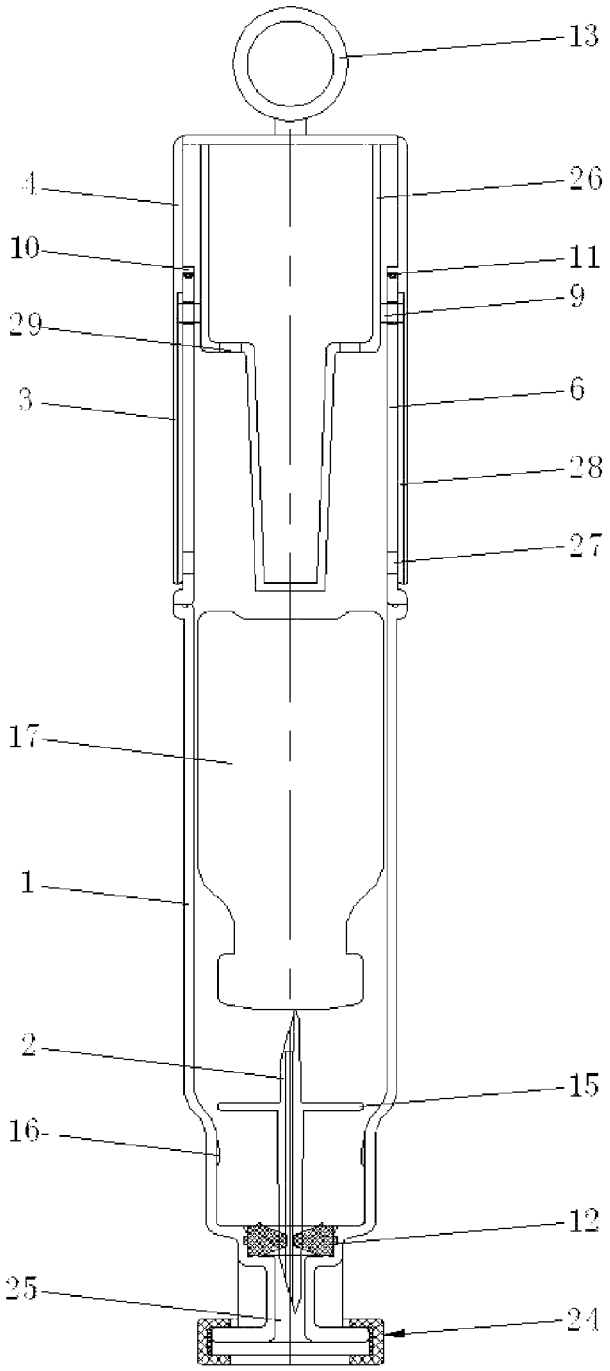
FIG. 27 is a schematic view showing the structure of the third preassembled medicine mixer.

Reference may be made to FIGS. 25 and 26 for the structure of a push device used in the second preassembled medicine mixer.

The push device used in the second preassembled medicine mixer includes a rotary sleeve 4, a guide sleeve I 3, a guide sleeve II 6 and a guide component. The guide sleeve I 3 protrudes into the guide sleeve II 6. A guide through groove 8 is provided axially in the side wall of the guide sleeve I 3 (in this example, two guide grooves 8 are axially symmetrically provided in the side wall of the guide sleeve I 3), and both ends of the guide through groove 8 extend a certain distance in opposite directions on the circumference of the guide sleeve I 3. The direction in which the bottom end of the guide through groove 8 extends in the circumference of the guide sleeve I 3 conforms with the direction in which the rotary sleeve 4 rotates when the medicine container is pushed. The rotary sleeve 4 has the top end sealed and has the bottom end connected to the top end of the guide sleeve II 6 (butt jointed by welding). In this example, the guide sleeve II 6 and the rotary sleeve 4 are integrally formed. The guide component is arranged in the guide sleeve I 3, and a guide block 9 is arranged on the outer side of the guide component, such that the guide block 9 passes through the guide through groove 8 and protrudes into the guide spiral groove 7, to allow the rotary sleeve 4 to cooperate with the guide sleeve I 3 in an axially fixed and radially rotatable manner.

The guide component is a flat plate, a grab bucket, a guide barrel or a push rod. The structures of the rotary sleeve 4, the guide sleeve I 3, the guide sleeve II 6, the guide barrel 5 and the push rod 26 are the same as the structures of those in the second preassembled medicine mixer, and are not described herein.

Assembling the push device used in the preassembled medicine mixer includes assembling the guide component (FIG. 25 shows that the guide component is embodied as a guide barrel 5, and FIG. 26 shows that the guide component is embodied as a push rod 26) into the guide sleeve II 6 first, and then inserting the guide block 9 on the guide component into the guide spiral groove 7 in the guide sleeve II 6, and then pushing the guide component to a junction end of the guide sleeve II 6 and the rotary sleeve 4; and then inserting the guide sleeve I 3 into the guide sleeve II 6, and allowing the guide block 9 on the guide component to pass through the guide through groove 8 in the guide sleeve I 3, and closing the rotary sleeve 4 onto the top of the guide sleeve I 3.

The method for medicine mixing by an assembly of the push device used in the second preassembled medicine mixer, the dosing barrel and the dosing double needle is the same as the method for medicine mixing by the second preassembled medicine mixer, and is not described herein.

Reference may be made to FIGS. 27 to 34 for the structure of the third preassembled medicine mixer.

The third preassembled medicine mixer includes a rotary sleeve 4, a guide sleeve I 3, a guide sleeve II 6, a guide component, a dosing barrel 1 and a dosing double needle 2.

Wherein, the structures of the dosing barrel 1 and the dosing double needle 2 in the dosing barrel 1 are the same as the structures of those in the first preassembled medicine mixer, and are not described herein.

Figure 28:
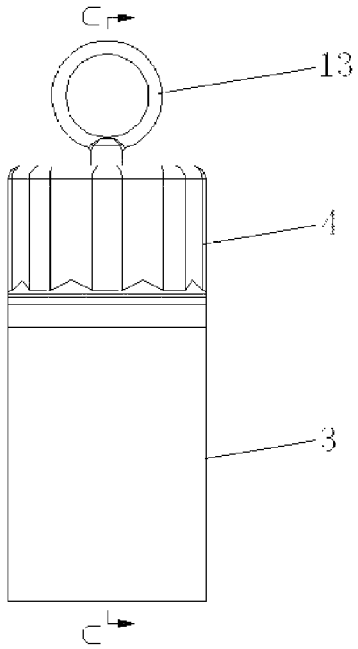
FIG. 28 is a front view showing a guide sleeve I and a rotary sleeve integrally formed in the third preassembled medicine mixer.
Figure 29:
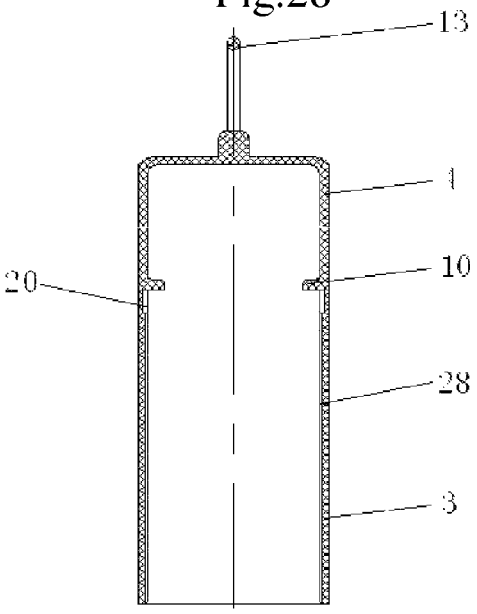
FIG. 29 is a sectional view along the direction of B-B in FIG. 28.
Figure 32:
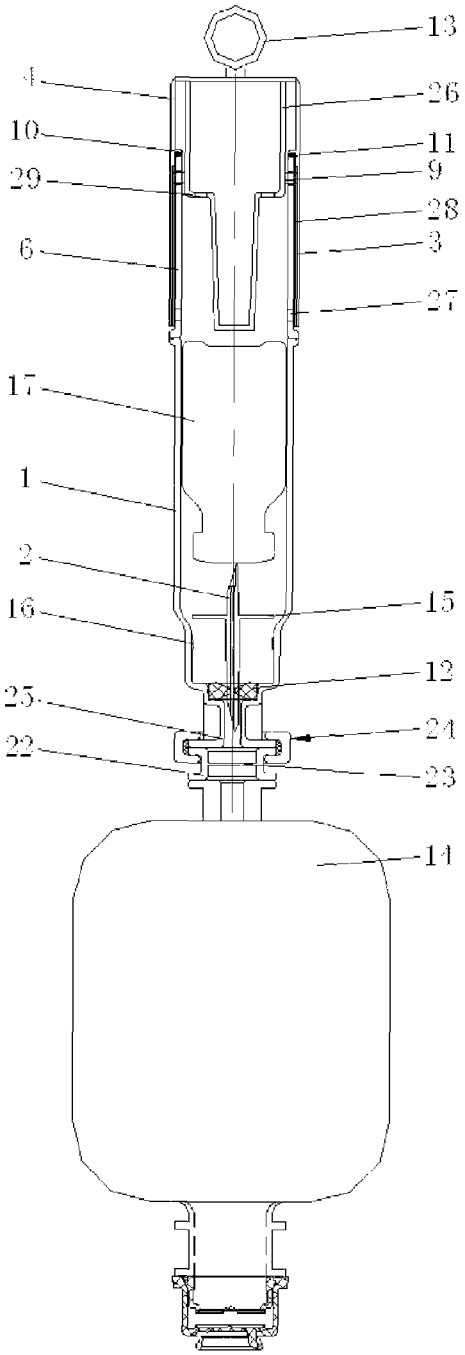
FIG. 32 is a schematic view showing the structure of the third preassembled medicine mixer which is connected to a transfusion container and in a state before use, employing the push rod as the guide component.
Figure 33:
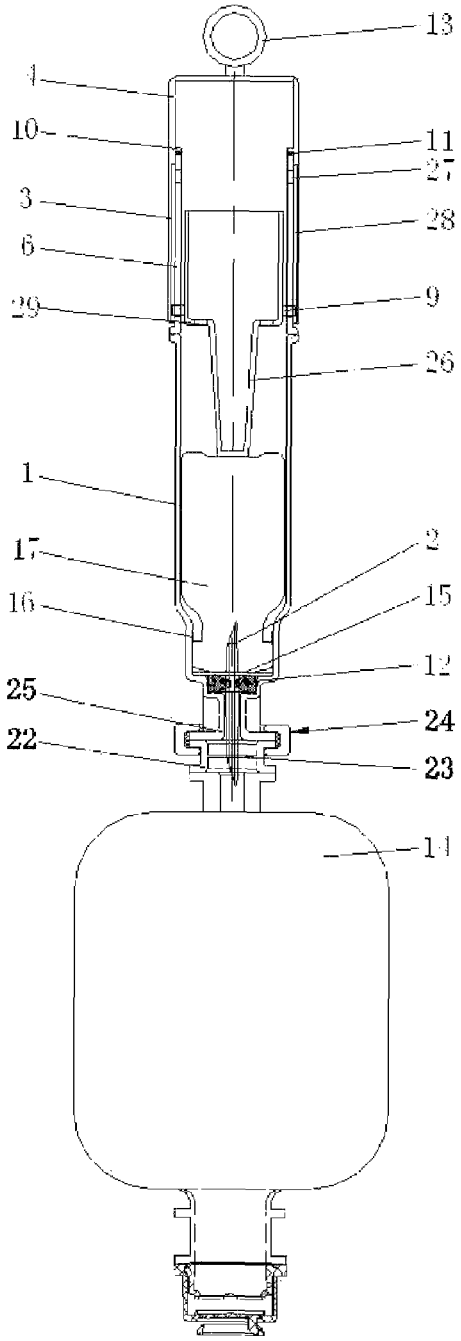
FIG. 33 is a schematic view showing the structure of the third preassembled medicine mixer which is connected to a transfusion container and in a state of being used, employing the push rod as the guide component.
Figure 34:
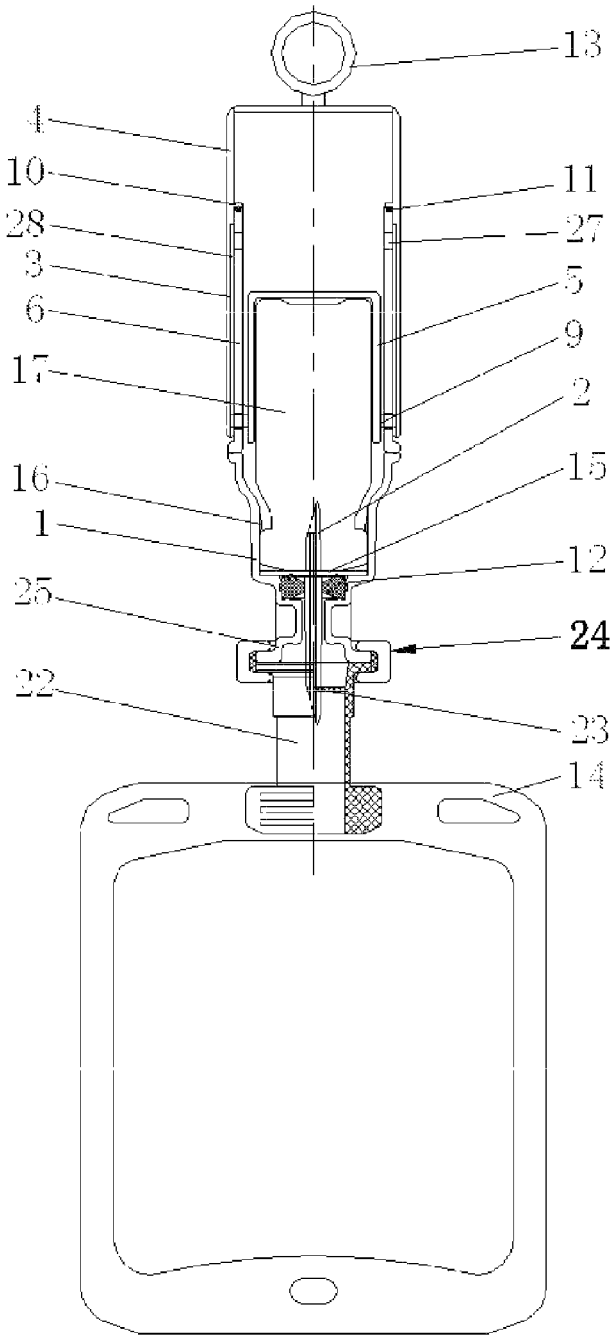
FIG. 34 is a schematic view showing the structure of the third preassembled medicine mixer which is connected to a transfusion container and in a state of being used, employing the guide barrel as the guide component.

The structures of the guide sleeve I 3 and the rotary sleeve 4 are as shown in FIGS. 28 and 29. The top end of the guide sleeve I 3 and the bottom end of the rotary sleeve 4 are connected (the connection can be achieved by butt jointing through welding), and the top end of the rotary sleeve 4 is sealed. In this example, the guide sleeve I 3 and the rotary sleeve 4 are integrally formed. A pressing ring 10 is provided circumferentially in the inner wall of the rotary sleeve 4, and an annular locker groove 20 is arranged circumferentially under the compressing ring 10. A guide groove 28 is provided axially in the side wall of the guide sleeve I 3 (in this example, two guide grooves 28 are axially symmetrically provided in the side wall of the guide sleeve I 3). Both ends of the guide groove 28 extend a certain distance in opposite directions on the circumference of the guide sleeve I 3. The direction in which the bottom end of the guide groove 28 extends in the circumference of the guide sleeve I 3 conforms with the direction in which the rotary sleeve 4 rotates when the medicine container is pushed. Before the medicine in the medicine container 17 and the solution in the transfusion container is mixed (as shown in FIG. 32), a guide block 9 on the guide component is located in a groove of the guide groove 28 at the top end and in the circumferential direction, which effectively prevents the guide component from moving downwards axially, and prevents the guide component from pushing the medicine container 17 to move downwards before mixing medicine. While the medicine in the medicine container 17 and the solution in the transfusion container 14 being is mixed (as shown in FIGS. 33 and 34), the guide block 9 on the guide component is located in a groove of the guide groove 28 at the bottom end in the circumferential direction, which effectively prevents the guide component from moving upwards axially, and thereby effectively preventing the medicine container 17 from retreating, and further ensuring that the medicine mixing can be carried out smoothly.

Figure 30:
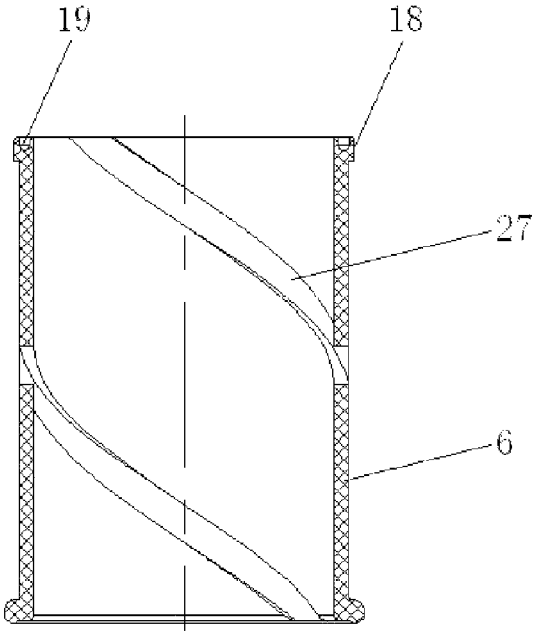
FIG. 30 is a schematic view showing the structure of the guide sleeve II in the third preassembled medicine mixer.

The structure of the guide sleeve II 6 is as shown in FIG. 30, the guide sleeve II 6 protrudes into the guide sleeve I 3. A guide spiral through groove 27 is provided in the inner wall of the guide sleeve II 6, and in this example, two guide spiral through grooves 27 are symmetrically provided in the inner wall of the guide sleeve II 6. The bottom end of the guide sleeve II 6 and the top end of the dosing barrel 1 are butt jointed in a sealed manner (the butt joint can be achieved by welding). An annular locker 18 is provided at the top of the outer wall of the guide sleeve II 6 in the circumferential direction, and an annular recess 19 is provided on the top end face of the guide sleeve II 6 in the circumferential direction. In a state that the rotary sleeve 4 is installed on the guide sleeve II 6, the annular locker 18 is located in the annular locker groove 20. A sealing ring 11 is installed in the annular recess 19, and the pressing ring 10 presses on the guide sleeve II 6 via the sealing ring 11 and cooperates with the guide sleeve II 6 in a sealed manner. When the rotary sleeve 4 is rotated, the annular locker 18 is rotated in the annular locker groove 20, and due to the sealing effect of the sealing ring 11, not only the rotary sleeve 4 is rotatable on the guide sleeve II 6, but also the sealing between the inner wall of the rotary sleeve 4 and the top of the guide sleeve II 6 can be achieved.

Figure 31:
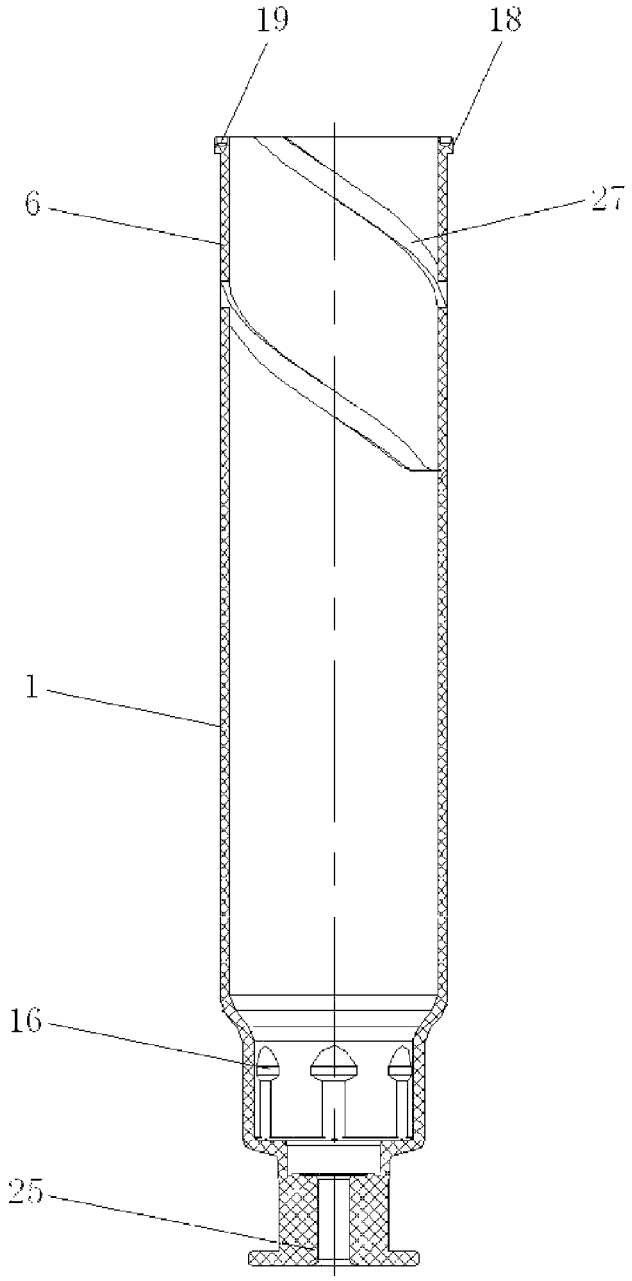
FIG. 31 is a sectional schematic view showing the structure of the dosing barrel and the guide sleeve II integrally formed in the third preassembled medicine mixer.

The guide sleeve II 6 and the dosing barrel 1 can be integrally formed, as shown in FIG. 31.

The guide component is arranged in the guide sleeve II 6, and a guide block 9 is arranged on the outer side of the guide component, such that the guide block 9 passes through the guide spiral through groove 27 and protrudes into the guide groove 28, to allow the rotary sleeve 4 to cooperate with the guide sleeve II 6 in an axially fixed and radially rotatable manner. The guide component is a flat plate, a grab bucket, a guide barrel or a push rod. The structures of the guide barrel 5 and the push rod 26 are the same as the structures of those in the first preassembled medicine mixer, and the installing positions and working principles of the flat plate, the grab bucket, the guide barrel or the push rod are all the same as the installing positions and working principles of those in the first preassembled medicine mixer, and are not described any more. A clamping assembly 24 is also arranged at the bottom of the dosing barrel 1, and a lifting ring 13 is arranged at the top of the rotary sleeve 4.

Using the third preassembly medicine mixer in which the guide component is embodied as a push rod includes: connecting the bottom end of the dosing barrel 1 and the interface 22 on the transfusion container 14 via the clamping assembly 24 in a sealed manner first, as shown in FIG. 32, preassembling the medicine container 17 into the dosing barrel 1 in a sterile condition, and keeping the medicine container 17 and the dosing double needle 2 in a sealed condition via a diaphragm 23 in the interface 22 and a rotary sleeve 4 having the top end being sealed, and hence may achieve absolute sterile transportation and storage. Mixing medicine may include rotating the rotary sleeve 4, such that the rotary sleeve 4 drives the push rod 26 to move downwards rapidly along the guide spiral through groove 27 in the inner wall of the guide sleeve II 6, to directly apply a pressure to the medicine container 17, and further push the dosing double needle 2 to move downwards, such that an upper needle tip of the dosing double needle 2 punctures through a sealing plug on the medicine container 17, and a lower needle tip of the dosing double needle 2 punctures through the diaphragm 23 in the interface 22, to allow the medicine container 17 to be instantaneously communicated with the transfusion soft bag, as shown in FIG. 33. When the guide block 9 on the push rod 26 moves downwards in a groove at the bottom end of the guide groove 28 in the circumferential direction, the medicine container 17 is pushed to have a container cap of the container located below the slip-proof buckles 16, which effectively prevents the medicine container 17 from retreating, and ensures the medicine mixing to be carried out smoothly. Since the medicine container and the components directly contact with the medicine involved in a process from the medicine container being preassembled into the preassembled medicine mixer till completion of the transfusion are all in a sterile condition, thus, the sterile sealing in an overall process of transportation, storage, butt jointing, mixing medicine and transfusion can be achieved. Before medicine mixing and when in medicine mixing, the medicine container 17 is located in the dosing barrel 1, and since the dosing barrel 1 is made of a transparent material, the operator may see the information of the medicine dispensed in the medicine container 17 simply through the transparent dosing barrel 1, which is advantageous for the operator to get the information of the medicine dispensed in a timely manner, and to avoid dispensing error of the medicine.

The dosing barrel 1 may also be embodied as a structure of a medicine mixing clamping body as shown in FIG. 34, and the guide component is embodied as a guide barrel 5. When use, it is required to preassemble the medicine container 17 into the guide barrel 5 in a sterile condition first, and allow the medicine container 17 and the dosing double needle 2 to be in a sealed state via the diaphragm 23 in the interface 22 and the rotary sleeve 4 with the top end being sealed, and hence may achieve the absolute sterile in the transportation and storage. Mixing medicine may include rotating the rotary sleeve 4 such that the rotary sleeve 4 drives the guide sleeve 5 to move downwards rapidly along the guide spiral through groove 27 in the inner wall of the guide sleeve II 6, and further brings the medicine container 17 in the guide barrel 5 to move downwards. The medicine container 17 applies pressure to the dosing double needle 2 and drives the dosing double needle 2 to move downwards, and the upper needle tip of the dosing double needle 2 punctures through the sealing plug on the medicine container 17, and the lower needle tip of the dosing double needle 2 punctures through the diaphragm 23 in the interface 22, to allow the medicine container 17 and the transfusion soft bag to be communicated instantaneously, as shown in FIG. 34. The medicine container 17 is preassembled in the guide barrel 5, thus significantly reduces the distance by which the guide barrel 5 and the medicine container 17 move downwards (i.e., medicine mixing in a short travel is achieved).

Figure 35:
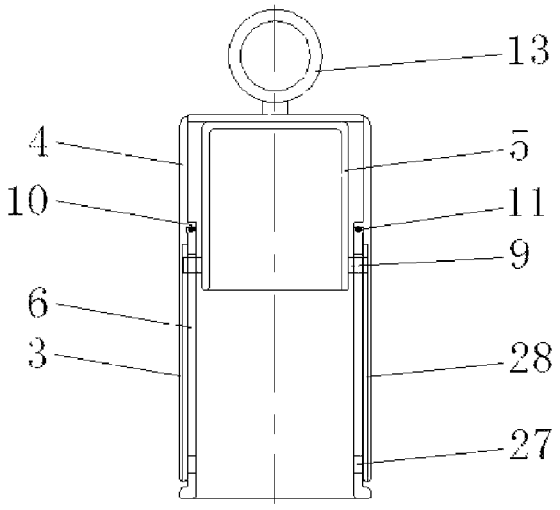
FIG. 35 is a schematic view showing the structure of a push device used in the third preassembled medicine mixer, employing the guide barrel as the guide component.
Figure 36:
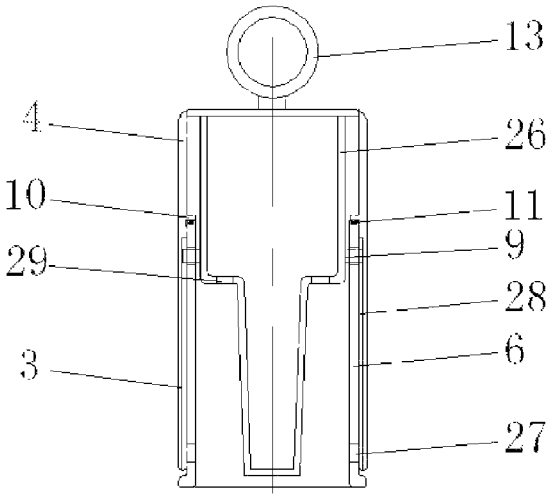
FIG. 36 is a schematic view showing the structure of a push device used in the third preassembled medicine mixer, employing the push rod as the guide component.
Figure 37:
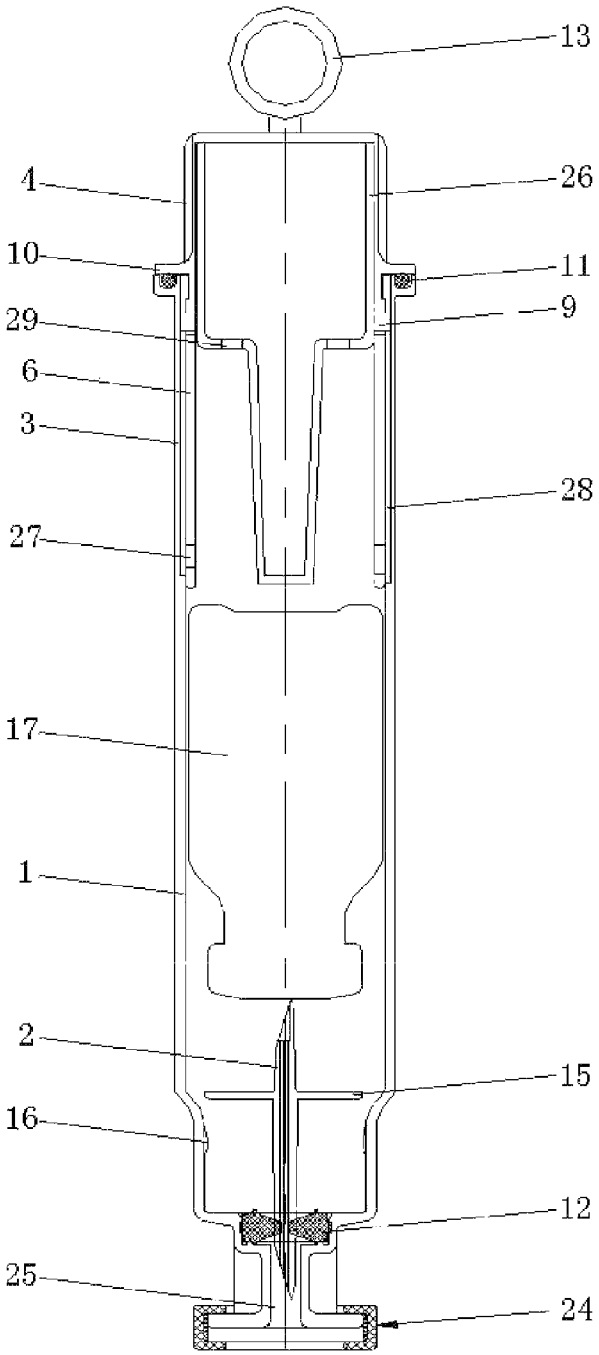
FIG. 37 is a schematic view showing the structure of the fourth preassembled medicine mixer.

Reference may be made to FIGS. 35 and 36 for the structure of a push device used in the third preassembled medicine mixer.

The push device used in this preassembled medicine mixer includes a rotary sleeve 4, a guide sleeve I 3, a guide sleeve II 6 and a guide component. The guide sleeve II 6 protrudes into the guide sleeve I 3, and a guide spiral through groove 27 is provided in the inner wall of the guide sleeve II 6 (in this example, two guide spiral through grooves 27 are symmetrically provided in the inner wall of the guide sleeve II 6). The top end of the guide sleeve I 3 is connected to the bottom end of the rotary sleeve 4 (butt jointed by welding), and the top end of the rotary sleeve 4 is sealed. In this example, the guide sleeve I 3 and the rotary sleeve 4 are integrally formed. A guide groove 28 is provided axially in the side wall of the guide sleeve I 3 (in this example, two guide grooves 28 are axially symmetrically provided in the side wall of the guide sleeve I 3), both ends of the guide groove 28 extend a certain distance in opposite directions on the circumference of the guide sleeve I 3. The direction in which the bottom end of the guide groove 28 extends in the circumference of the guide sleeve I 3 conforms with the direction in which the rotary sleeve 4 rotates when the medicine container is pushed. The guide component is arranged in the guide sleeve II 6, and a guide block 9 is arranged on the outer side of the guide component. The guide block 9 passes through the guide spiral through groove 27 and protrudes into the guide groove 28, to allow the rotary sleeve 4 to cooperate with the guide sleeve II 6 in an axially fixed and radially rotatable manner.

Assembling the push device used in the preassembled medicine mixer includes assembling the guide component (FIG. 35 shows that the guide component is embodied as a guide barrel 5, and FIG. 35 shows that the guide component is embodied as a push rod 26) into the guide sleeve I 3 first, and then inserting the guide block 9 on the guide component into the guide groove 28 in the guide sleeve I 3, and then pushing the guide component to a junction end of the guide sleeve I 3 and the rotary sleeve 4; and then inserting the guide sleeve II 6 into the guide sleeve I 3, and allowing the guide block 9 on the guide component to pass through the guide spiral through groove 27 in the guide sleeve II 6, and closing the rotary sleeve 4 onto the top of the guide sleeve II 6.

The method for medicine mixing by an assembly of the push device used in the third preassembled medicine mixer, the dosing barrel and the dosing double needle is the same as the method for medicine mixing by the third preassembled medicine mixer, and is not described herein.

Reference may be made to FIGS. 37 to 44 for the structure of the fourth preassembled medicine mixer.

The preassembled medicine mixer includes a rotary sleeve 4, a guide sleeve I 3, a guide sleeve II 6, a guide component, a dosing barrel 1 and a dosing double needle 2.

The structures of the dosing barrel 1 and the dosing double needle 2 in the dosing barrel 1 are the same as the structures of those in the first preassembled medicine mixer, and are not described herein.

Figure 38:
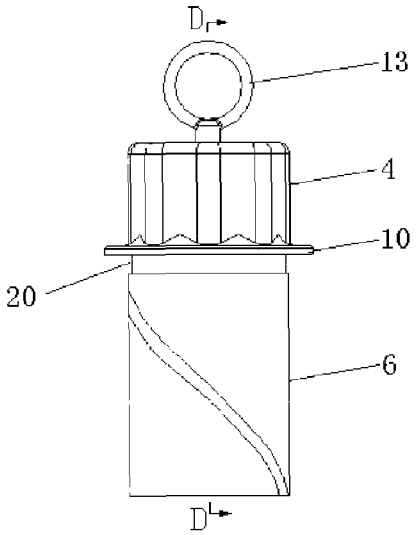
FIG. 38 is a front view showing a guide sleeve II and a rotary sleeve integrally formed in the fourth preassembled medicine mixer.
Figure 39:
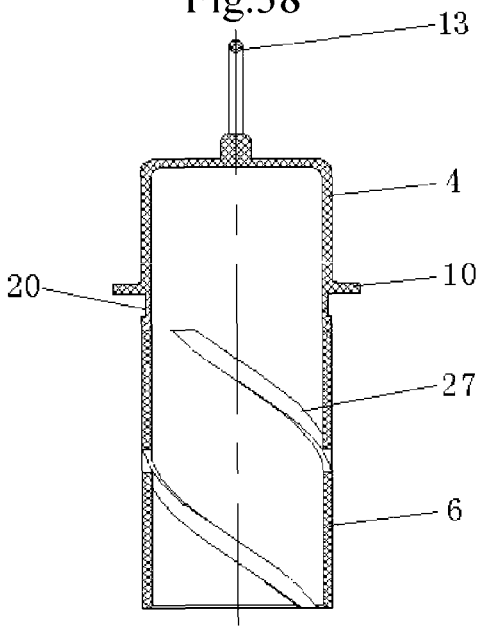
FIG. 39 is a sectional view along the direction of D-D in FIG. 38.

The structures of the guide sleeve II 6 and the rotary sleeve 4 are as shown in FIGS. 38 and 39, the top end of the guide sleeve II 6 is connected to the bottom end of the rotary sleeve 4 (may be butt jointed by welding). In this example, the guide sleeve II 6 and the rotary sleeve 4 are integrally formed, and the top end of the rotary sleeve 4 is sealed. A guide spiral through groove 27 is provided in the inner wall of the guide sleeve II 6, and in this example, two guide spiral through grooves 27 are symmetrically provided in the inner wall of the guide sleeve II 6. A pressing ring 10 is arranged on the outer wall of the rotary sleeve 4 in the circumferential direction, and an annular locker groove 20 is arranged under the pressing ring 10 in the circumferential direction.

Figure 40:
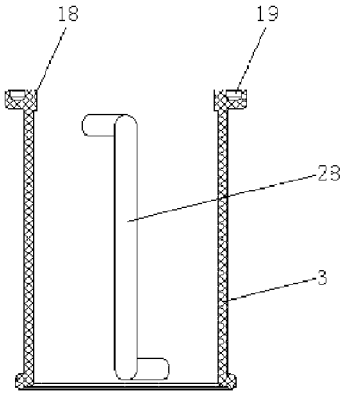
FIG. 40 is a schematic view showing the structure of the guide sleeve I in the fourth preassembled medicine mixer.
Figure 42:
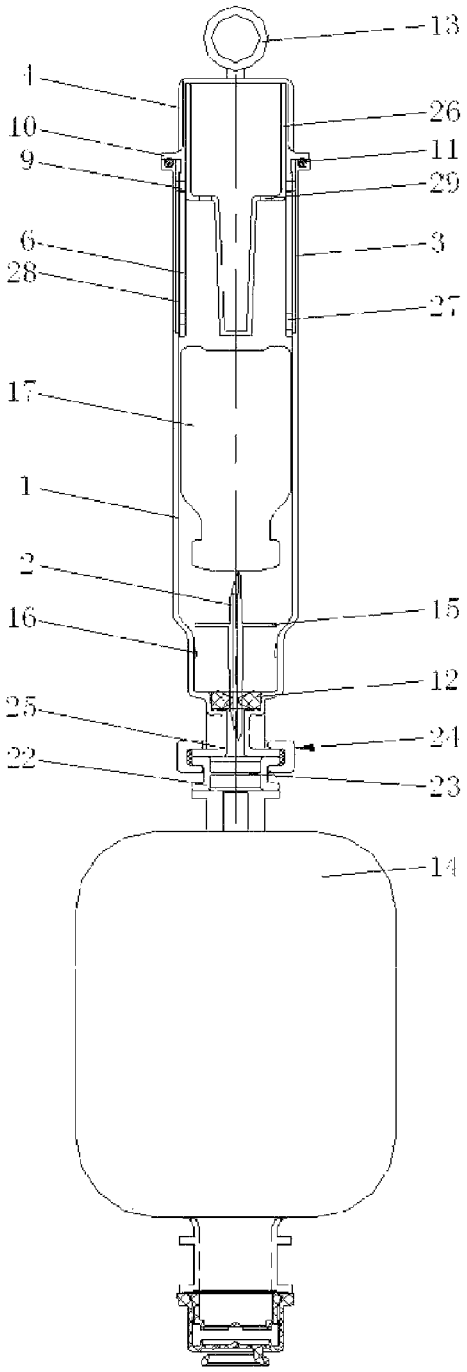
FIG. 42 is a schematic view showing the structure of the fourth preassembled medicine mixer which is connected to a transfusion container and in a state before use, employing the push rod as the guide component.
Figure 43:
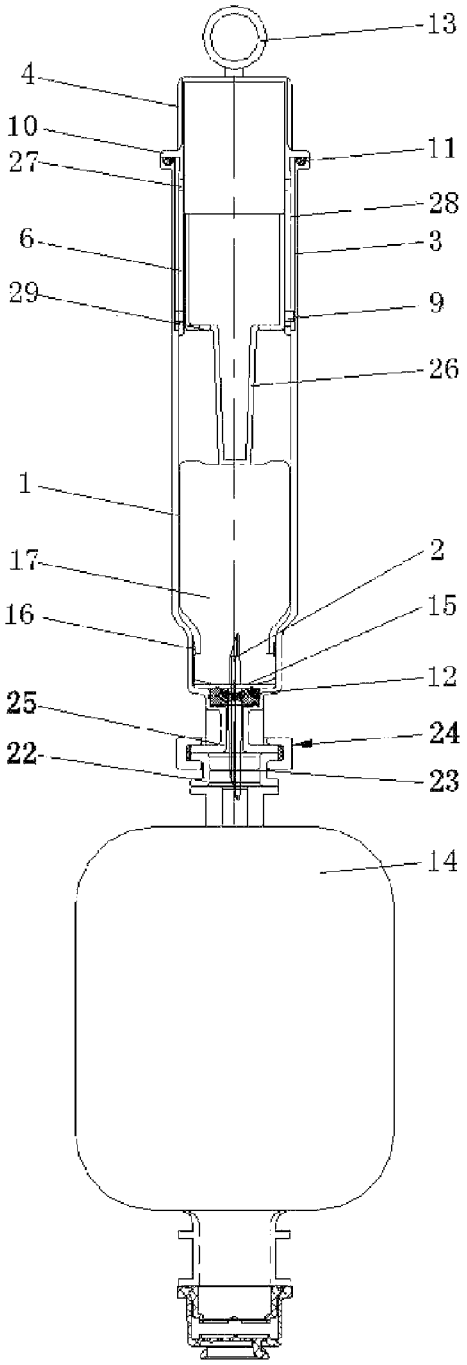
FIG. 43 is a schematic view showing the structure of the fourth preassembled medicine mixer which is connected to a transfusion container and in a state of being used, employing the push rod as the guide component.
Figure 44:
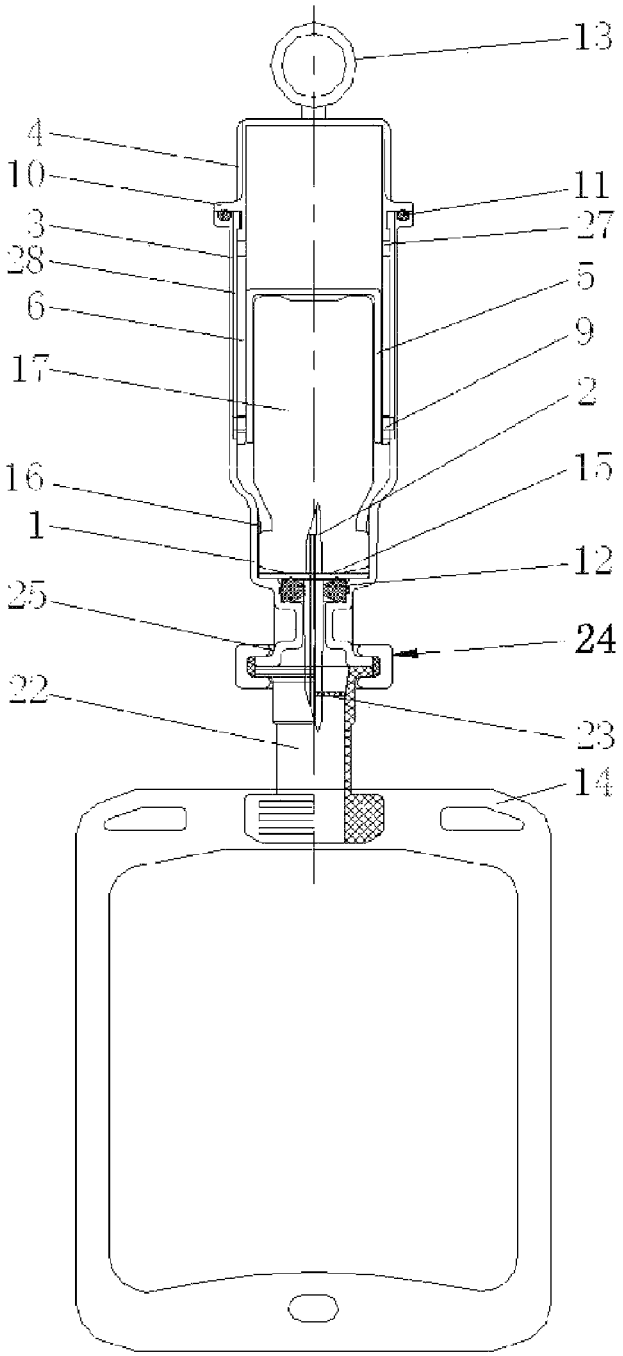
FIG. 44 is a schematic view showing the structure of the fourth preassembled medicine mixer which is connected to a transfusion container and in a state of being used, employing the guide barrel as the guide component.

The structure of the guide sleeve I 3 is as shown in FIG. 40, and the bottom end of the guide sleeve I 3 and the top end of the dosing barrel 1 are butt jointed in a sealed manner (the connection can be achieved by welding). The guide sleeve II 6 protrudes into the guide sleeve I 3. An annular locker 18 is provided at the top of the inner wall of the guide sleeve I 3 in the circumferential direction, and an annular recess 19 is provided on the top end face of the guide sleeve I 3 in the circumferential direction. In a state that the rotary sleeve 4 is installed on the guide sleeve I 3, the annular locker 18 is located in the annular locker groove 20. A sealing ring 11 is installed in the annular recess 19, and the pressing ring 10 presses on the guide sleeve I 3 via the sealing ring 11 and cooperates with the guide sleeve I 3 in a sealed manner. When the rotary sleeve 4 is rotated, the annular locker 18 is rotated in the annular locker groove 20, and due to the sealing effect of the sealing ring 11, not only the rotary sleeve 4 is rotatable on the guide sleeve I 3, but also the sealing between the outer wall of the rotary sleeve 4 and the top of the guide sleeve I 3 can be achieved. A guide groove 28 is provided axially in the side wall of the guide sleeve I 3 (in this example, two guide grooves 28 are axially symmetrically provided in the side wall of the guide sleeve I 3). Both ends of the guide groove 28 extends on the circumference of the guide sleeve I 3 by a certain distance along the opposite direction, to form a character "z"-shaped guide groove 28. The direction in which the bottom end of the guide groove 28 extends in the circumference of the guide sleeve I 3 conforms with the direction in which the rotary sleeve 4 rotates when the medicine container is pushed. Before the medicine in the medicine container 17 and the solution in the transfusion container 14 is mixed (as shown in FIG. 42), a guide block 9 on the guide component is located in a groove of the guide groove 28 at the top end and in the circumferential direction, which effectively prevents the guide component from moving downwards axially, and prevents the guide component from pushing the medicine container 17 to move downwards before medicine mixing. And while the medicine in the medicine container 17 and the solution in the transfusion container 14 is mixed (as shown in FIGS. 43 and 44), the guide block 9 on the guide component is located in a groove of the guide groove 28 at the bottom end in the circumferential direction, which effectively prevents the guide component from moving upwards axially, and thereby effectively preventing the medicine container 17 from retreating, and further ensuring that the medicine mixing can be carried out smoothly.

Figure 41:
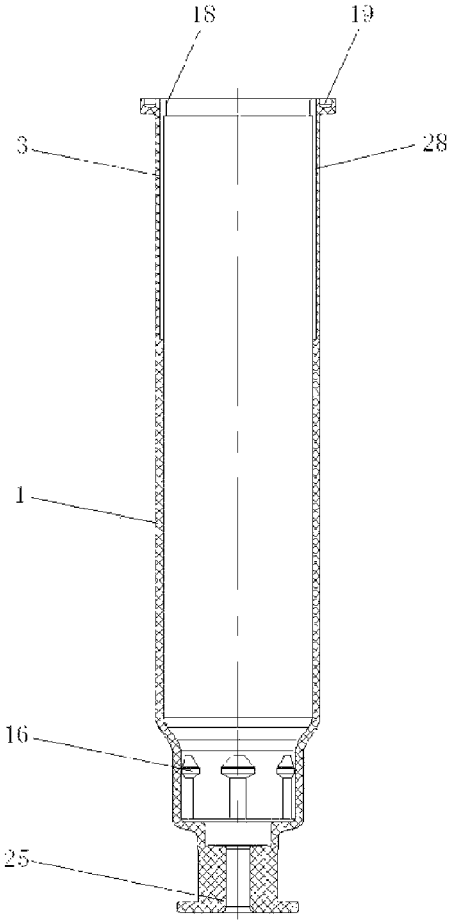
FIG. 41 is a sectional schematic view showing the structure of the dosing barrel and the guide sleeve I integrally formed in the fourth preassembled medicine mixer.

The guide sleeve I 3 and the dosing barrel 1 can be integrally formed as shown in FIG. 41.

The guide component is arranged in the guide sleeve II 6, and a guide block 9 is arranged on the outer side of the guide component, such that the guide block 9 passes through the guide spiral through groove 27 and protrudes into the guide groove 28, to allow the rotary sleeve 4 to cooperate with the guide sleeve I 3 in an axially fixed and radially rotatable manner. The guide component is a flat plate, a grab, a guide barrel, or a push rod. The guide barrel 5 and the push rod 26 have the same structures as the structures of those in the first preassembled medicine mixer, and the installing positions and working principles of the flat plate, the grab bucket, the guide barrel or the push rod are all the same as the installing positions and working principles of those in the first preassembled medicine mixer, and are not described any more herein. A clamping assembly 24 is also provided at the bottom of the dosing barrel 1, and a lifting ring 13 is arranged at the top of the rotary sleeve 4.

Using the fourth preassembled medicine mixer in which the guide component is embodied as a push rod includes: connecting the bottom end of the dosing barrel 1 and the interface 22 on the transfusion container 14 via the clamping assembly 24 in a sealed manner first, as shown in FIG. 42, preassembling the medicine container 17 into the dosing barrel 1 in a sterile condition, and keeping the medicine container 17 and the dosing double needle 2 in a sealed condition via the diaphragm 23 in the interface 22 and a rotary sleeve 4 having the top end being sealed, and hence may achieve absolute sterile transportation and storage. Mixing medicine may include rotating the rotary sleeve 4, such that the rotary sleeve 4 drives the push rod 26 to move downwards rapidly along the guide groove 28 in the inner wall of the guide sleeve I 3, to directly apply a pressure to the medicine container 17, and further push the dosing double needle 2 to move downwards, such that an upper needle tip of the dosing double needle 2 punctures through a sealing plug on the medicine container 17, and a lower needle tip of the dosing double needle 2 punctures through the diaphragm 23 in the interface 22, to allow the medicine container 17 to be instantaneously communicated with the transfusion soft bag, as shown in FIG. 43. When the guide block 9 on the push rod 26 moves downwards in a groove at the bottom end of the guide groove 28 in the circumferential direction, the medicine container 17 is pushed to have a container cap of the container located below the slip-proof buckles 16, which effectively prevents the medicine container 17 from retreating, and ensures the medicine mixing to be carried out smoothly. Since the medicine container and the components directly contact with the medicine involved in a process from the medicine container being preassembled into the preassembled medicine mixer till completion of the transfusion are all in a sterile condition, the sterile sealing in an overall process of transportation, storage, butt jointing, mixing medicine and transfusion can be achieved. Before medicine mixing and when in medicine mixing, the medicine container 17 is located in the dosing barrel 1, and since the dosing barrel 1 is made of a transparent material, the operator may see the information of the medicine dispensed in the medicine container 17 simply through the transparent dosing barrel 1, which is advantageous for the operator to get the information of the medicine dispensed in a timely manner, and to avoid dispensing error of the medicine.

The dosing barrel 1 may also be embodied as a structure of a medicine mixing clamping body as shown in FIG. 44, and the guide component is embodied as a guide barrel 5. When use, it is required to preassemble the medicine container 17 into the guide barrel 5 in a sterile condition first, and allow the medicine container 17 and the dosing double needle 2 to be in a sealed state via the diaphragm 23 in the interface 22 and the rotary sleeve 4 with the top end being sealed, and hence may achieve the absolute sterile in the transportation and storage. Mixing medicine may include rotating the rotary sleeve 4 such that the rotary sleeve 4 drives the guide sleeve 5 to move downwards rapidly along the guide groove 28 in the inner wall of the guide sleeve I 3, and further brings the medicine container 17 in the guide barrel 5 to move downwards. The medicine container 17 applies pressure to the dosing double needle 2 and drives the dosing double needle 2 to move downwards, and the upper needle tip of the dosing double needle 2 punctures through the sealing plug on the medicine container 17, and the lower needle tip of the dosing double needle 2 punctures through the diaphragm 23 in the interface 22, to allow the medicine container 17 and the transfusion soft bag to be communicated instantaneously, as shown in FIG. 44. The medicine container 17 is preassembled in the guide barrel 5, thus significantly reduces the distance by which the guide barrel 5 and the medicine container 17 move downwards (i.e., medicine mixing in a short travel is achieved).

Figure 45:
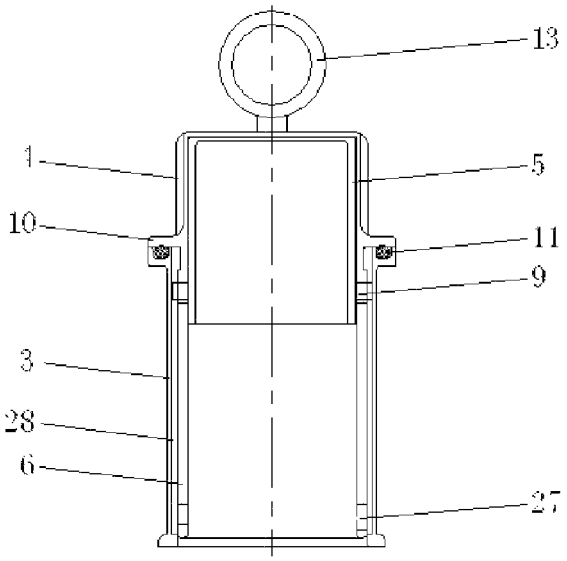
FIG. 45 is a schematic view showing the structure of the push device used in the fourth preassembled medicine mixer, employing the guide barrel as the guide component.
Figure 46:
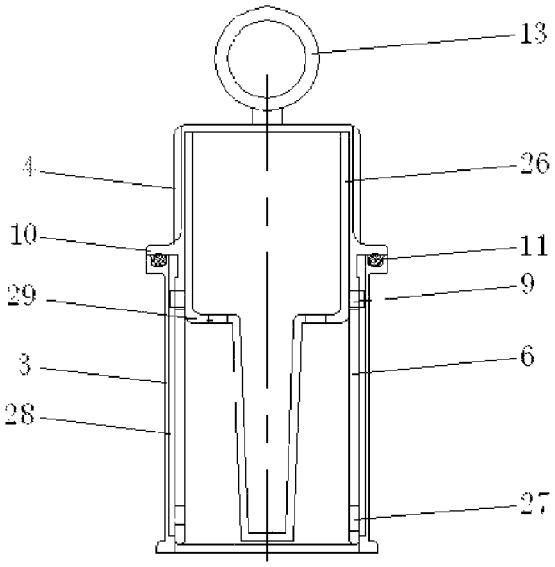
FIG. 46 is a schematic view showing the structure of the push device used in the fourth preassembled medicine mixer, employing the push rod as the guide component.

Reference may be made to FIGS. 45 and 46 for the structure of a push device used in a fourth preassembled medicine mixer.

The push device used in this preassembled medicine mixer includes a rotary sleeve 4, a guide sleeve I 3, a guide sleeve II 6 and a guide component. The guide sleeve II 6 protrudes into the guide sleeve I 3, and the top end of the guide sleeve II 6 is connected to the bottom end of the rotary sleeve 4 (butt jointed by welding). A guide spiral through groove 27 is provided in the inner wall of the guide sleeve II 6 (in this example, two guide spiral through grooves 27 are symmetrically provided in the inner wall of the guide sleeve II 6). In this example, the guide sleeve II 6 and the rotary sleeve 4 are integrally formed. A guide groove 28 is provided axially in the side wall of the guide sleeve I 3 (in this example, two guide grooves 28 are provided axially in the side wall of the guide sleeve I 3), both ends of the guide groove 28 extend a certain distance in opposite directions on the circumference of the guide sleeve I 3. The direction in which the bottom end of the guide groove 28 extends in the circumference of the guide sleeve I 3 conforms with the direction in which the rotary sleeve 4 rotates when the medicine container is pushed. The guide component is arranged in the guide sleeve II 6, and a guide block 9 is arranged on the outer side of the guide component. The guide block 9 passes through the guide spiral through groove 27 and protrudes into the guide groove 28, to allow the rotary sleeve 4 to cooperate with the guide sleeve I 3 in an axially fixed and radially rotatable manner.

The guide component is a flat plate, a grab, a guide barrel, or a push rod. The rotary sleeve 4, the guide sleeve I 3, the guide sleeve II 6, the guide barrel 5 and the push rod 26 have the same structures as the structures of those in the fourth preassembled medicine mixer, and are not described any more herein.

Assembling the push device used in this preassembled medicine mixer includes assembling the guide component (FIG. 45 shows that the guide component is embodied as a guide barrel 5, and FIG. 46 shows that the guide component is embodied as a push rod 26.) in the guide sleeve II 6 first, and then allowing the guide block 9 on the guide component to pass through the guide spiral through groove 27 in the guide sleeve II 6, and then pushing the guide component to a junction end of the guide sleeve II 6 and the rotary sleeve 4; and then sleeving the guide sleeve I 3 on the guide sleeve II 6, to allow the guide block 9 on the guide component to be inserted into the guide groove 28 in the guide sleeve I 3, and closing the rotary sleeve 4 onto the top of the guide sleeve I 3.

The method for medicine mixing by an assembly of the push device used in the fourth preassembled medicine mixer, the dosing barrel and the dosing double needle is the same as the method for medicine mixing by the fourth preassembled medicine mixer, and is not described herein.

It is to be noted finally that, the above examples is only intended to illustrate technical solutions of the present invention rather than a limitation to the present invention. Though the present invention has been described in detail with reference to the preferred examples, it should be appreciated by the person skilled in the art that, modifications or equivalent substitutions can be made to the technical solutions of the present invention without departing from the spirit and scope of the technical solutions of the present invention, and these modifications or equivalent substitutions are also encompassed in the scope defined by the claims of the present invention.

The invention claimed is:

1. A preassembled medicine mixer, comprising a rotary sleeve, a guide sleeve I, a guide sleeve II, a guide component, a dosing barrel and a dosing double needle, with the dosing double needle being arranged in the dosing barrel, characterized in that, the dosing barrel has one end serving as an interface connecting end, and has the other end connected to one end of one of the guide sleeve I or the guide sleeve II;

a guide through groove is provided axially in the side wall of the guide sleeve I, both ends of the guide through groove extend a certain distance in opposite directions on the circumference of the guide sleeve I, and a direction in which a bottom end of the guide through groove extends in the circumference of the guide sleeve I conforms with a direction in which the rotary sleeve rotates when a medicine container is pushed;

one of the guide sleeve I or the guide sleeve II has one end protruding into the other one of the guide sleeve I or the guide sleeve II, and has the other end connected with one end of the rotary sleeve, a guide spiral groove is provided in the inner wall of the guide sleeve II; and the guide component is arranged inside one of the guide sleeve I or the guide sleeve II, and a guide block is provided on an outer side of the guide component, the guide block passes through the guide through groove and protrudes into the guide spiral groove, to allow the rotary sleeve to cooperate with the other one of the guide sleeve I or the guide sleeve II in an axially fixed and radially rotatable manner.

2. The preassembled medicine mixer according to claim 1, characterized in that the guide component is a flat plate, a grab bucket, a guide barrel or a push rod;

an opening of the grab bucket corresponds to the dosing double needle; and the guide barrel has one end open, and the open end of the guide barrel corresponds to the dosing double needle, the inner chamber of the guide barrel is an accommodating chamber for the medicine container;

the other end of the rotary sleeve is a sealed end.

3. The preassembled medicine mixer according to claim 1, characterized in that a pressing ring is provided on the outer wall of the rotary sleeve in the circumferential direction, the pressing ring presses on the other end of the guide sleeve II, and cooperates with one of the guide sleeve I or the guide sleeve II in a rotatable and sealed manner;

the pressing ring cooperates with the other end of the other one of the guide sleeve I or the guide sleeve II in a sealed manner via a sealing ring.

4. The preassembled medicine mixer according to claim 1, characterized in that two guide spiral grooves are symmetrically provided in the inner wall of the guide sleeve II, and two guide through grooves are axially symmetrically provided in the side wall of the guide sleeve I, two guide blocks are symmetrically provided on the outer side of the guide component, one of the blocks passes through one of the guide spiral groove or guide through groove and protrudes into the other one of the guide spiral groove or guide through groove, and the other guide block passes through one of the guide spiral groove or guide spiral groove and protrudes into the other one of the guide spiral groove or guide through groove.

5. The preassembled medicine mixer according to claim 1, characterized in that two barb-shaped slip-proof buckles for preventing the medicine container from loosening are symmetrically provided on the inner wall of the dosing barrel.

6. The preassembled medicine mixer according to claim 1, characterized in that an annular rubber cushion is provided on the inner wall of the dosing barrel and close to the interface connecting end, and a needle tip of the dosing double needle corresponding to the interface connecting end passes through the annular rubber cushion.

7. The preassembled medicine mixer according to claim 1, characterized in that a clamping assembly for connecting an interface of the transfusion container and the interface connecting end is arranged at a bottom end of the dosing barrel;

the clamping assembly is an annular locker which comprises a first arcuate locker and a second arcuate locker, a sealing gasket is arranged on each of the inner wall of the first arcuate locker and the second arcuate locker, the first arcuate locker has one end hinged to one end of the second arcuate locker and has the other end clamped to the other end of the second arcuate locker.

8. A preassembled medicine mixer, comprising a rotary sleeve, a guide sleeve I, a guide sleeve II, a guide component, a dosing barrel and a dosing double needle, with the dosing double needle being arranged in the dosing barrel, characterized in that, the dosing barrel has one end serving as an interface connecting end, and has the other end connected to one end of one of the guide sleeve I or the guide sleeve II;

a guide spiral groove is provided in the inner wall of the guide sleeve II; and the other one of the guide sleeve II or the guide sleeve II is connected to one end of the rotary sleeve;

the other end of one of the guide sleeve I or the guide sleeve II protrudes into the other one of the guide sleeve I or the guide sleeve II, a guide through groove is provided axially in the side wall of the guide sleeve I, both ends of the guide through groove extend a certain distance in opposite directions on the circumference of the guide sleeve I, and a direction in which a bottom end of the guide through groove extends in the circumference of the guide sleeve I conforms with a direction in which the rotary sleeve rotates when a medicine container is pushed; and the guide component is arranged inside one of the guide sleeve I or the guide sleeve II, and a guide block is provided on an outer side of the guide component, the guide block passes through the guide through groove or the guide spiral groove and protrudes into the guide spiral groove or guide through groove, to allow the rotary sleeve to cooperate with the other one of the guide sleeve I or the guide sleeve II in an axially fixed and radially rotatable manner.

9. The preassembled medicine mixer according to claim 8, characterized in that the guide component is a flat plate, a grab bucket, a guide barrel or a push rod;

an opening of the grab bucket corresponds to the dosing double needle; and the guide barrel has one end open, and the open end of the guide barrel corresponds to the dosing double needle, the inner chamber of the guide barrel is an accommodating chamber for the medicine container;

the other end of the rotary sleeve is a sealed end.

10. The preassembled medicine mixer according to claim 8, characterized in that a pressing ring is provided on the inner wall of the rotary sleeve in the circumferential direction, the pressing ring presses on the other end of the guide sleeve I, and cooperates with the guide sleeve I in a rotatable and sealed manner;

the pressing ring cooperates with the other end of one of the guide sleeve I or the guide sleeve II in a sealed manner via a sealing ring.

11. The preassembled medicine mixer according to claim 8, characterized in that two guide spiral grooves are symmetrically provided in the inner wall of the guide sleeve II, and two guide through grooves are axially symmetrically provided in the side wall of the guide sleeve I, two guide blocks are symmetrically provided on the outer side of the guide component, one of the blocks passes through one guide through groove/guide spiral groove and protrudes into one guide spiral groove/guide through groove, and the other guide block passes through the other guide through groove/guide spiral groove and protrudes into the other guide spiral groove/guide through groove.

12. The preassembled medicine mixer according to claim 8, characterized in that two barb-shaped slip-proof buckles for preventing the medicine container from loosening are symmetrically provided on the inner wall of the dosing barrel.

13. The preassembled medicine mixer according to claim 8, characterized in that an annular rubber cushion is provided on the inner wall of the dosing barrel and close to the interface connecting end, and a needle tip of the dosing double needle corresponding to the interface connecting end passes through the annular rubber cushion.

14. The preassembled medicine mixer according to claim 8, characterized in that a clamping assembly for connecting an interface of the transfusion container and the interface connecting end is arranged at a bottom end of the dosing barrel;

the clamping assembly is an annular locker which comprises a first arcuate locker and a second arcuate locker, a sealing gasket is arranged on each of the inner wall of the first arcuate locker and the second arcuate locker, the first arcuate locker has one end hinged to one end of the second arcuate locker and has the other end clamped to the other end of the second arcuate locker.

15. A push device used in a preassembled medicine mixer, characterized in that, the push device comprising a rotary sleeve, a guide sleeve I, a guide sleeve II and a guide component, one of the guide sleeve I or the guide sleeve II has one end protruding into the other one of the guide sleeve I or the guide sleeve II, and has the other end connected with one end of the rotary sleeve;

a guide through groove is provided axially in the side wall of the guide sleeve I, both ends of the guide through groove extend a certain distance in opposite directions on the circumference of the guide sleeve I, and a direction in which a bottom end of the guide through groove extends in the circumference of the guide sleeve I conforms with a direction in which the rotary sleeve rotates when a medicine container is pushed;

a guide spiral groove is provided in the inner wall of the guide sleeve II; and the guide component is arranged inside one of the guide sleeve I or the guide sleeve II, and a guide block is provided on an outer side of the guide component, the guide block passes through the guide through groove and protrudes into the guide spiral groove, to allow the rotary sleeve to cooperate with the other one of the guide sleeve I or the guide sleeve II in an axially fixed and radially rotatable manner.

16. The push device used in a preassembled medicine mixer according to claim 15, characterized in that the guide component is a flat plate, a grab bucket, a guide barrel or a push rod;

an opening of the grab bucket faces downwards; and the guide barrel has one end open, and the open end of the guide barrel faces downwards, and the inner chamber of the guide barrel is an accommodating chamber for the medicine container;

the other end of the rotary sleeve is a sealed end.

17. The push device used in a preassembled medicine mixer according to claim 15, characterized in that a pressing ring is provided on the outer wall of the rotary sleeve in the circumferential direction, the pressing ring presses on the other end of one of the guide sleeve I or the guide sleeve II, and cooperates with the guide sleeve II in a rotatable and sealed manner;

the pressing ring cooperates with the other end of the other one of the guide sleeve I or the guide sleeve II in a sealed manner via a sealing ring.

18. The push device used in a preassembled medicine mixer according to claim 15, characterized in that, two guide spiral grooves are symmetrically provided in the inner wall of the guide sleeve II, and two guide through grooves are axially symmetrically provided in the side wall of the guide sleeve I;

two guide blocks are symmetrically provided on the outer side of the guide component, one of the blocks passes through one of the guide spiral groove or guide through groove and protrudes into the other one of the guide spiral groove or guide through groove, and the other guide block passes through one of the guide spiral groove or guide through groove and protrudes into the other one of the guide spiral groove or guide through groove.

19. A push device used in a preassembled medicine mixer, characterized in that, the push device comprising a rotary sleeve, a guide sleeve I, a guide sleeve II, and a guide component, one of the guide sleeve I or the guide sleeve II has one end protruding into one of the guide sleeve I the other or the guide sleeve II, wherein one of the guide sleeve I or the guide sleeve II is connected to one end of the rotary sleeve;

a guide through groove is provided axially in the side wall of the guide sleeve I, both ends of the guide through groove extend a certain distance in opposite directions on the circumference of the guide sleeve I, and a direction in which a bottom end of the guide through groove extends in the circumference of the guide sleeve I conforms with a direction in which the rotary sleeve rotates when a medicine container is pushed;

a guide spiral groove is provided in the inner wall of the guide sleeve II, and the guide component is arranged inside one of the guide sleeve I or the guide sleeve II, and a guide block is provided on an outer side of the guide component, the guide block passes through the guide through groove and protrudes into the guide spiral groove, to allow the rotary sleeve to cooperate with the other one of the guide sleeve I or the guide sleeve II in an axially fixed and radially rotatable manner.

20. The push device used in a preassembled medicine mixer according to claim 19, characterized in that the guide component is a flat plate, a grab bucket, a guide barrel or a push rod;

an opening of the grab bucket faces downwards; and the guide barrel has one end open, and the open end of the guide barrel faces downwards, and the inner chamber of the guide barrel is an accommodating chamber for the medicine container;

the other end of the rotary sleeve is a sealed end.

21. The push device used in a preassembled medicine mixer according to claim 19, characterized in that a pressing ring is provided on the inner wall of the rotary sleeve in the circumferential direction, the pressing ring presses on the other end of one of the guide sleeve I or the guide sleeve II, and cooperates with the other one of the guide sleeve I or the guide sleeve II in a rotatable and sealed manner;

the pressing ring cooperates with the other end of one of the guide sleeve I or the guide sleeve II in a sealed manner via a sealing ring.

22. The push device used in a preassembled medicine mixer according to claim 19, characterized in that two guide spiral grooves are symmetrically provided in the inner wall of the guide sleeve II, and two guide through grooves are axially symmetrically provided in the side wall of the guide sleeve I, two guide blocks are symmetrically provided on the outer side of the guide component, one of the blocks passes through one guide through one of the guide spiral groove or guide through groove and protrudes into the other one of the guide spiral groove or guide through groove, and the other guide block passes through one of the guide spiral groove or guide through groove and protrudes into the other one of the guide spiral groove or guide through groove.

* * * * *